US009631855B2

(12) United States Patent
Dodson

(10) Patent No.: US 9,631,855 B2
(45) Date of Patent: Apr. 25, 2017

(54) MODULAR DUAL VECTOR FLUID SPRAY NOZZLES

(71) Applicant: Mitchell Joe Dodson, Park City, UT (US)

(72) Inventor: Mitchell Joe Dodson, Park City, UT (US)

( * ) Notice: Subject to any disclaimer, the term of this patent is extended or adjusted under 35 U.S.C. 154(b) by 285 days.

(21) Appl. No.: 14/013,582

(22) Filed: Aug. 29, 2013

(65) Prior Publication Data

US 2014/0103147 A1 Apr. 17, 2014

Related U.S. Application Data

(60) Provisional application No. 61/694,262, filed on Aug. 29, 2012, provisional application No. 61/694,255, filed on Aug. 29, 2012, provisional application No. 61/694,250, filed on Aug. 29, 2012, provisional application No. 61/694,256, filed on Aug. 29, 2012.

(51) Int. Cl.

| | |
|---|---|
| ***B05B 1/02*** | (2006.01) |
| ***F25C 3/04*** | (2006.01) |
| ***B05B 1/04*** | (2006.01) |
| ***B05B 1/14*** | (2006.01) |

(52) U.S. Cl.

CPC ..... *F25C 3/04* (2013.01); *B05B 1/02* (2013.01); *B05B 1/04* (2013.01); *B05B 1/042* (2013.01); *B05B 1/044* (2013.01); *B05B 1/048* (2013.01); *B05B 1/14* (2013.01)

(58) Field of Classification Search

CPC .. B05B 1/02; B05B 1/04; B05B 1/044; B05B 1/042

USPC ..... 239/597, 601, 589, 599, 284.1; 138/39, 138/44, 109, 111, DIG. 11

See application file for complete search history.

(56) References Cited

U.S. PATENT DOCUMENTS

| | | | | |
|---|---|---|---|---|
| 686,818 | A * | 11/1901 | MacPhail | F16L 9/003 138/151 |
| 1,844,187 | A | 2/1932 | Smith | |
| 2,341,859 | A * | 2/1944 | Lowell | B05B 1/042 239/543 |
| 3,301,485 | A | 1/1967 | Tropeano et al. | |
| 3,383,054 | A | 5/1968 | Nugarus | |
| 3,716,190 | A | 2/1973 | Lindlof | |
| 3,761,020 | A | 9/1973 | Tropeano et al. | |

(Continued)

FOREIGN PATENT DOCUMENTS

| | | |
|---|---|---|
| CA | 2015646 C | 7/2002 |
| DE | 2855906 A1 | 7/1980 |

(Continued)

*Primary Examiner* — Arthur O Hall
*Assistant Examiner* — Alexander Valvis
(74) *Attorney, Agent, or Firm* — Paul C. Oestreich; Eminent IP, P.C.

(57) ABSTRACT

Various embodiments of modular dual vector fluid spray nozzles are disclosed. Embodiments of the nozzles are characterized by specially shaped fluid channels, impingement surfaces and exit orifices used to generate atomized mists of fluid under pressure. Embodiments of the nozzles are generally characterized by composite fluid spray density patterns having horizontal and vertical components, i.e., dual vector in nature. The nozzles disclosed are modular and may be easily installed or removed from a given fluid spray system, nozzle head, or fixture as dictated by any given application.

8 Claims, 15 Drawing Sheets

(56) References Cited

U.S. PATENT DOCUMENTS

| | | | | |
|---|---|---|---|---|
| 3,776,471 | A | 12/1973 | Meyer et al. | |
| 3,908,903 | A | 9/1975 | Burns, Jr. | |
| 3,969,908 | A | 7/1976 | Lawless et al. | |
| 4,004,732 | A | 1/1977 | Hanson | |
| 4,141,507 | A | 2/1979 | Rump | |
| 4,145,000 | A | 3/1979 | Smith et al. | |
| 4,343,434 | A | 8/1982 | Haruch | |
| 4,349,156 | A | 9/1982 | Haruch et al. | |
| 4,353,504 | A | 10/1982 | Girardin et al. | |
| 4,383,646 | A | 5/1983 | Smith | |
| 4,442,047 | A | 4/1984 | Johnson | |
| 4,465,230 | A | 8/1984 | Ash | |
| 4,516,722 | A | 5/1985 | Avery | |
| 4,646,977 | A * | 3/1987 | Iwamura | B05B 7/0416 239/590.5 |
| 4,742,959 | A | 5/1988 | Stanchak et al. | |
| 4,793,554 | A | 12/1988 | Kraus et al. | |
| 4,903,895 | A | 2/1990 | Mathewson et al. | |
| 4,915,302 | A | 4/1990 | Kraus et al. | |
| 4,993,635 | A | 2/1991 | Dupre | |
| 5,004,151 | A | 4/1991 | Dupre | |
| 5,064,118 | A | 11/1991 | Lauricella | |
| 5,090,619 | A | 2/1992 | Barthold et al. | |
| 5,135,167 | A | 8/1992 | Ringer | |
| 5,154,348 | A | 10/1992 | Ratnik et al. | |
| 5,520,331 | A | 5/1996 | Wolfe | |
| 5,529,242 | A | 6/1996 | Hedin | |
| 5,593,090 | A | 1/1997 | Werner | |
| 5,692,682 | A | 12/1997 | Soule et al. | |
| 5,699,961 | A | 12/1997 | Ratnik et al. | |
| 5,810,251 | A | 9/1998 | McKinney | |
| 5,823,436 | A | 10/1998 | Waldrum | |
| 5,909,844 | A | 6/1999 | Nilsson | |
| 5,934,556 | A | 8/1999 | Charriau et al. | |
| 6,007,676 | A | 12/1999 | Bartels et al. | |
| 6,032,872 | A | 3/2000 | Dupre | |
| 6,119,956 | A | 9/2000 | McKinney | |
| 6,129,290 | A | 10/2000 | Nikkanen | |
| 6,152,380 | A | 11/2000 | Dupre | |
| 6,161,769 | A | 12/2000 | Kircher et al. | |
| 6,182,905 | B1 | 2/2001 | Dupre | |
| 6,402,047 | B1 | 6/2002 | Thomas | |
| 6,402,062 | B1 * | 6/2002 | Bendig | B05B 1/042 239/589 |
| 6,508,412 | B1 | 1/2003 | Pergay et al. | |
| 6,547,157 | B2 | 4/2003 | Jervas | |
| 6,719,209 | B1 | 4/2004 | Pergay et al. | |
| 6,793,148 | B2 | 9/2004 | Ratnik | |
| 7,114,662 | B1 | 10/2006 | Nikkanen | |
| 7,124,964 | B2 | 10/2006 | Bui | |
| 7,481,284 | B2 * | 1/2009 | Wells | E21B 10/61 175/340 |
| 7,516,911 | B2 * | 4/2009 | Chung | B05B 1/00 239/106 |
| 7,546,960 | B2 | 6/2009 | Stofner | |
| 7,770,816 | B2 | 8/2010 | Rieder | |
| 8,393,553 | B2 | 3/2013 | Sankrithi et al. | |
| 8,534,577 | B2 | 9/2013 | Dodson | |
| D692,528 | S | 10/2013 | Dodson | |
| D692,982 | S | 11/2013 | Dodson | |
| D693,902 | S | 11/2013 | Dodson | |
| 2004/0046041 | A1 | 3/2004 | Dupre | |
| 2004/0112976 | A1 | 6/2004 | Galvin et al. | |
| 2006/0049273 | A1 | 3/2006 | Zhang | |
| 2006/0071091 | A1 | 4/2006 | Ratnik | |
| 2006/0113400 | A1 | 6/2006 | Dodson | |
| 2007/0069049 | A1 * | 3/2007 | Lipthal | B05B 1/042 239/597 |
| 2011/0168808 | A1 | 7/2011 | Mitch | |

FOREIGN PATENT DOCUMENTS

| | | | |
|---|---|---|---|
| DE | 29438056 | A | 3/1981 |
| DE | 19819982 | A1 | 9/1999 |
| DE | 19838785 | A1 | 3/2000 |
| DE | 10215580 | A1 | 10/2003 |
| DE | 102004053984 | B3 | 6/2006 |
| EP | 0787959 | A1 | 8/1997 |
| EP | 00824658 | B1 | 2/1998 |
| EP | 00835162 | B1 | 4/1998 |
| EP | 1283400 | A2 | 2/2003 |
| EP | 1473528 | A1 | 11/2004 |
| FR | 2594528 | A1 | 8/1987 |
| FR | 2617273 | A1 | 12/1988 |
| FR | 2877076 | A1 | 4/2006 |
| GB | 2214108 | A | 8/1989 |
| JP | 2005127577 | A | 5/2005 |
| WO | WO90/12264 | A1 | 10/1990 |
| WO | WO94/19655 | A1 | 9/1994 |
| WO | WO97/01392 | A1 | 1/1997 |
| WO | WO03/054460 | A1 | 7/2003 |
| WO | WO03/084668 | A2 | 10/2003 |
| WO | WO2004/087329 | A1 | 10/2004 |
| WO | WO2009/043092 | A1 | 4/2009 |
| WO | WO2010/036372 | A1 | 4/2010 |

* cited by examiner

MODULAR DUAL VECTOR FLUID SPRAY NOZZLES

CROSS-REFERENCE TO RELATED APPLICATIONS

This U.S. Nonprovisional Patent Application claims benefit of U.S. Provisional Patent Application No. 61/694,262, filed, Aug. 29, 2012, titled: MODULAR DUAL VECTOR FLUID SPRAY NOZZLES, Aug. 29, 2013 and U.S. Provisional Patent Application No. 61/694,255, filed, Aug. 29, 2012, titled: SIX-STEP SNOW-MAKING GUN, Aug. 29, 2013 and U.S. Provisional Patent Application No. 61/694,250, filed, Aug. 29, 2012, titled: FOUR-STEP SNOW-MAKING GUN, Aug. 29, 2013 and U.S. Provisional Patent Application No. 61/694,256, filed, Aug. 29, 2012, titled: SINGLE-STEP SNOW-MAKING GUN, Aug. 29, 2013. The contents of the aforementioned provisional patent application are expressly incorporated by reference, for all purposes, as if fully set forth herein.

This U.S. Non-provisional Patent Application is further related to U.S. patent application Ser. No. 12/998,141, filed on Mar. 22, 2011, titled: FLAT JET FLUID NOZZLES WITH ADJUSTABLE DROPLET SIZE INCLUDING FIXED OR VARIABLE SPRAY ANGLE, pending, which is a National Stage of International Patent Application No. PCT/US2009/005345 filed on Sep. 25, 2009, titled: FLAT JET FLUID NOZZLES WITH ADJUSTABLE DROPLET SIZE INCLUDING FIXED OR VARIABLE SPRAY ANGLE, now expired, which in turn claims benefit and priority to Australian Provisional Patent Application No. 2008904999, filed on Sep. 25, 2008, titled "PLUMES", also expired. Finally, this U.S. Non-provisional Patent Application is further related to contemporaneously filed U.S. Non-provisional Patent Application titled: SINGLE AND MULTI-STEP SNOWMAKING GUNS, filed Aug. 29, 2013, pending. The contents of all of the aforementioned patent applications are expressly incorporated by reference, for all purposes, as if fully set forth herein.

BACKGROUND OF THE INVENTION

Field of the Invention

The present invention relates generally to fluid spray nozzles. More particularly, this invention relates to modular dual vector fluid spray nozzles useful for any kind of fluid spraying application, e.g., and not by way of limitation, snowmaking, fire-suppression, fire-fighting, paint and solvent spraying.

Description of Related Art

Nozzles for converting fluids, such as water, under pressure into atomized mists, or plumes of vapor, are well known in the art. Nozzles find use in many applications, for example, irrigation, landscape watering, fire-fighting, and even solvent and paint spraying. Nozzles are also used in snowmaking equipment to provide atomized mists of water droplets of a size suitable for projection through a cold atmosphere to be frozen into snow for artificial snowmaking at ski resorts. Conventional nozzles are known to provide fluid mist jets of a particular shape of spray pattern, for example conical mist spray patterns are commonly used for garden hose nozzles. Nozzles that provide a flat jet (fan shaped) have proved particularly useful with regard to snowmaking, fire-fighting and irrigation. However, the density of spray achieved by flat jet nozzles is largely along a plane formed by the orifice and direction of trajectory, thus limiting the fluid density along directions away from this plane of trajectory.

There is a need for improved fluid spray nozzles having fluid trajectories in cross-planes. It would also be useful to have such improved nozzles that are modular without moving parts for ease of servicing and replacement within a fluid spray system. Such improved nozzles may provide greater control over the following nozzle spray variables: fluid flow rate, droplet size formed at ejection orifice, spray pattern and spray angle.

SUMMARY OF THE INVENTION

Various embodiments of dual vector fluid nozzles are disclosed. A particular embodiment of a fluid nozzle may include an integral cylindrical housing including a fluid channel having a fluid channel axis disposed coaxially through the cylindrical housing from a fluid intake port on a proximate end to a slotted orifice at a distal end. The embodiment of the fluid channel may further include a plurality of cylindrical sub-channels, each of the plurality of sub-channels having a sub-channel axis parallel to the fluid channel axis beginning from the intake port and passing through the slotted orifice. The embodiment of the fluid channel may further include each of the cylindrical sub-channels formed by a bore hole beginning from the proximate end of the cylindrical housing and ending in opposed hemispherical impingement surfaces at the slotted orifice.

Another embodiment of a fluid nozzle is disclosed. The fluid nozzle may include an integral cylindrical housing including a fluid channel disposed therein having a fluid channel axis disposed coaxially through the cylindrical housing from a fluid intake port on a proximate end to a cross-slotted orifice at a distal end. The embodiment of a fluid channel may further include a plurality of cylindrical sub-channels, each of the plurality of sub-channels having a sub-channel axis parallel to the fluid channel axis beginning from the intake port and passing through the cross-slotted orifice. The embodiment of a fluid channel may further include each of the cylindrical sub-channels formed by a bore hole beginning from the proximate end of the cylindrical housing and ending in opposed semi-spherical impingement surfaces at the cross-slotted orifice.

Still another embodiment of a fluid nozzle is disclosed. The fluid nozzle may include an integral cylindrical housing including a fluid channel having a fluid channel axis disposed coaxially through the cylindrical housing from a fluid intake port on a proximate end to a main slotted orifice at a distal end. The fluid channel may further include a plurality of cylindrical sub-channels, each of the plurality of sub-channels having a sub-channel axis parallel to the fluid channel axis beginning from the intake port and passing through the main slotted orifice or one of two secondary slotted orifices, the two secondary slotted orifices formed in the distal end of the housing and disposed parallel to, and on opposite sides of, the main slotted orifice. The fluid channel may further include each of the cylindrical sub-channels formed by boring a hole beginning from the proximate end of the cylindrical housing and ending in opposed hemispherical impingement surfaces at one of the main or secondary slotted orifices.

BRIEF DESCRIPTION OF THE DRAWINGS

The following drawings illustrate exemplary embodiments for practicing the invention. Like reference numerals refer to like parts in different views or embodiments of the present invention in the drawings.

DETAILED DESCRIPTION

Figure 1:
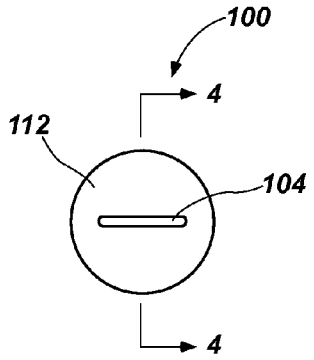
FIG. 1 is a front view of dual sub-chambered embodiment of a fluid nozzle, according to the present invention.

Various embodiments of dual vector fluid spray nozzles are disclosed herein. The novel nozzles are useful in any application where the conversion of a bulk fluid is desired to be atomized and sprayed. A non-exhaustive list of such applications may include: (1) the conversion of bulk water into fine atomized water particles for projection into a cold atmosphere with or without nucleation particles for the formation of artificial snow, (2) the conversion of bulk water into fine atomized water particles for projection onto burning objects for fire-fighting, fire control and fire suppression, (3) the conversion of bulk water into fine atomized water particles for projection into the atmosphere on restaurant patios for evaporative cooling, (4) the conversion of bulk oil into fine atomized oil mists for spraying onto mechanical parts for lubrication and corrosion control, and (5) the conversion of bulk solvent into fine atomized solvent particle spray mists for use in cleaning objects of any sort, (6) the conversion of bulk paint into fine atomized paint sprays for coating objects of any sort. One of ordinary skill in the art and given this disclosure will readily comprehend the vast number of possible applications for the nozzle technology disclosed herein. The application of this nozzle technology to such other possible, but not expressly disclosed, applications falls within the scope and spirit of this invention and its claims.

The various embodiments of dual vector fluid spray nozzles disclosed herein may be used with any suitable nozzle head, fluid delivery apparatus or fixture. Importantly, the technology disclosed herein is not limited to the type of nozzle head, fluid delivery apparatus, fixture or even the type of fluid used in the fluid spray nozzles. However, generally speaking, fluids which have low viscosity and can be readily formed into fine atomized particles are generally preferred fluids for use with the novel dual vector fluid spray nozzles disclosed herein.

The exemplary embodiments of dual vector fluid spray nozzles disclosed herein may be formed of any suitable material, e.g., and not by way of limitation, aluminum, stainless steel, titanium, brass or any other hard material that can be shaped as disclosed herein and withstand high pressure fluids passing through their intake ports, fluid chambers and exit orifices without, breaking, bending or flexing. The exemplary embodiments of dual vector fluid spray nozzles shown in the drawings will be described first, followed by more general embodiments and variations described subsequently.

Reference will now be made to FIGS. 1-7 of the drawings, which illustrate various views of an embodiment of a dual sub-chambered fluid nozzle 100. From FIGS. 1-7, it can be seen that nozzle 100 is generally cylindrical in nature. More particularly, FIG. 1 is a front view of an embodiment of a dual sub-chambered fluid nozzle 100, according to the present invention. The cross-section of face 102 of nozzle 100 may be generally circular as shown in FIG. 1. However, other cross-sectional variations of face 102 are contemplated, e.g., and not by way of limitation, square, pentagonal, hexagonal, octagonal, etc. Such other cross-sections may be particularly useful during installation and removal of the nozzle 100 from its fixture or nozzle head (see, e.g., 800, FIGS. 57A-57E.) For example, and not by way of limitation, square, hexagonal and octagonal shaped cross-sections may readily mate with wrenches or other tools used to install and remove the nozzles 100 from a fixture (not shown). FIG. 1 further illustrates a slotted orifice 104 in the face 102 of nozzle 100.

Figure 2:
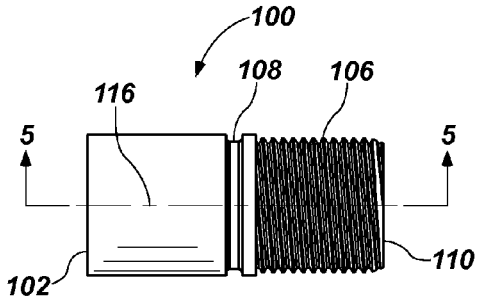
FIG. 2 is a right-side view of the embodiment shown in FIG. 1, according to the present invention.

FIG. 2 is a right-side view of the embodiment of nozzle 100 shown in FIG. 1, according to the present invention. FIG. 2 shows threading 106 located along the intake port end 110 of nozzle 100 that is configured to mate with an opening or socket (not shown) in a suitable fixture, e.g., a water nozzle head (also not shown). FIG. 2 also illustrates a circular sealing groove 108 located circumferentially around nozzle 100 and located between the face 102 and intake port end 110. Circular sealing groove 108 is configured to receive an O-ring (not shown) used to form a water tight seal between the nozzle 100 and the fixture (not shown) to which the nozzle 100 is mated. Threading 106 is located between circular sealing groove 108 and intake port end 110.

Figure 3:
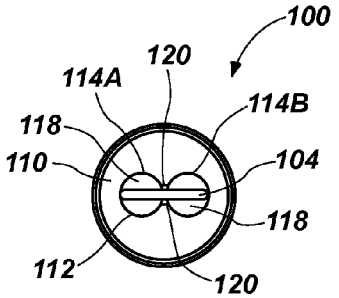
FIG. 3 is a rear view of the embodiment shown in FIGS. 1-2, according to the present invention.

FIG. 3 is a rear view of the embodiment of nozzle 100 shown in FIGS. 1-2, according to the present invention. From the rear view of nozzle 100, as shown in FIG. 3, the outline of the intake port 112 shows both of the dual sub-chambers 114A and 114B that are bored into the nozzle 100. The dual sub-chambers 114A and 114B may be formed parallel to one another by boring into nozzle 100 from the intake port end 110 in a direction parallel to the longitudinal axis 116 shown in dashed line in FIG. 2 and ending before reaching face 102 (FIGS. 1 and 2). Each of the dual sub-chambers 114A and 114B may be formed using a hemispherical boring tool that forms a hemispherical impingement surface (best shown in FIG. 5 at reference 118 as discussed below) adjacent to the slotted orifice 104. The intersection of the dual sub-chambers 114A and 114B are opposing ridges 120 that are located between the dual sub-chambers 114A and 114B.

Figure 4:
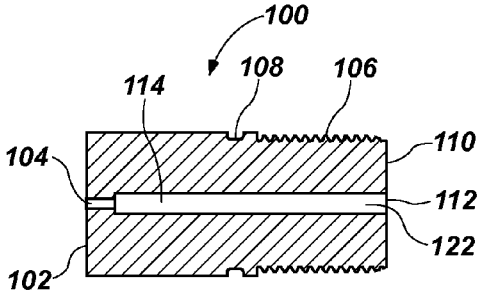
FIG. 4 is vertical section view of the embodiment shown in FIGS. 1-3 as indicated in FIG. 1, according to the present invention.

FIG. 4 is vertical cross-section view, as indicated in FIG. 1, of the embodiment of nozzle 100 shown in FIGS. 1-3, according to the present invention. FIG. 4 illustrates the threading 106 and circular sealing groove 108 shown in FIG. 2. FIG. 4 further illustrates a gap 122 between the opposing ridges 120 shown in FIG. 3 formed, e.g., by removing or boring along the longitudinal axis 116 with a smaller diameter boring tool (drill bit) than use to form the dual sub-chambers 114A and 114B. The gap 122 begins at the intake port end 110 and ends at the slotted orifice 104 before reaching the face 102. Fluid chamber 114 comprises the combination of the dual sub-chambers 114A and 114B.

Figure 5:
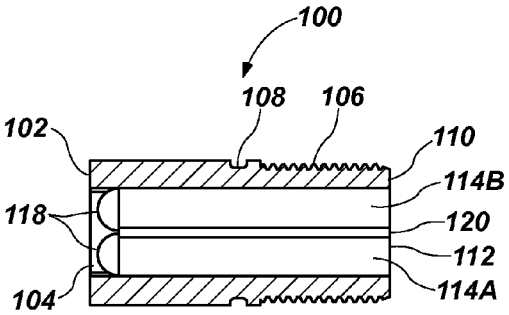
FIG. 5 is horizontal section view of the embodiment shown in FIGS. 1-4 as indicated in FIG. 2, according to the present invention.

FIG. 5 is horizontal cross-section view as indicated in FIG. 2 of the embodiment of a nozzle 100 shown in FIGS. 1-4, according to the present invention. FIG. 5 illustrates the generally cylindrical shape of the dual sub-chambers 114A and 114B and the hemispherical impingement surfaces 118 of the dual sub-chambers 114A and 114B adjacent to the slotted orifice 104. FIG. 5 also illustrates the threading 106 and circular sealing groove 108 of nozzle 100.

Figure 6:
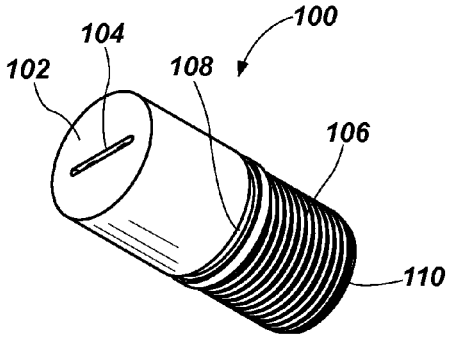
FIG. 6 is a front perspective view of the embodiment shown in FIGS. 1-5, according to the present invention.

FIG. 6 is a front perspective view of the embodiment of a nozzle 100 shown in FIGS. 1-5, according to the present invention. The face 102, slotted orifice 104, circular sealing groove 108, threading 106 and intake port end 110 of nozzle 100 are shown in FIG. 6.

Figure 7:
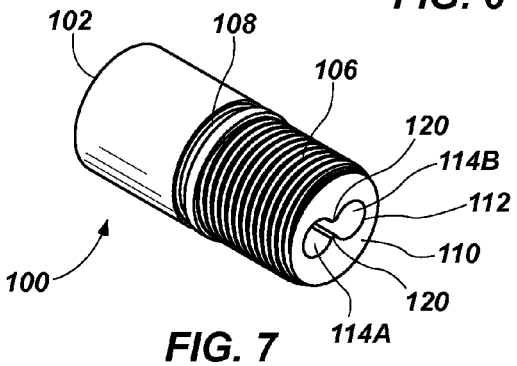
FIG. 7 is a rear perspective view of the embodiment shown in FIGS. 1-6, according to the present invention.
Figure 8A:
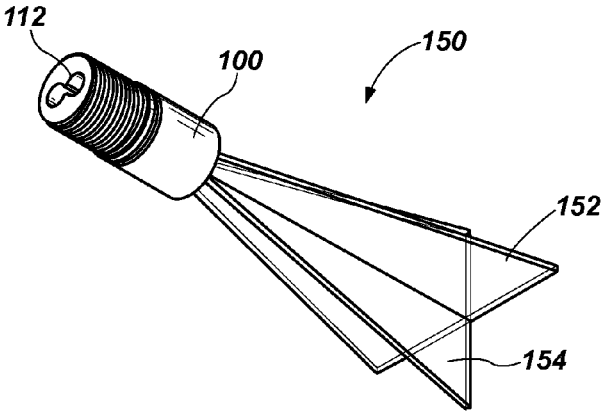
FIGS. 8A-8E are rear perspective, front perspective, rear, side and front views, respectively, of an exemplary peak spray density pattern achieved by the embodiment of a fluid nozzle shown in FIGS. 1-7, according to the present invention.
Figure 8B:
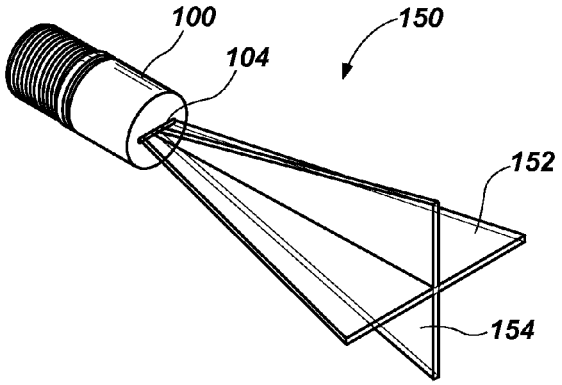
Figure 8C:
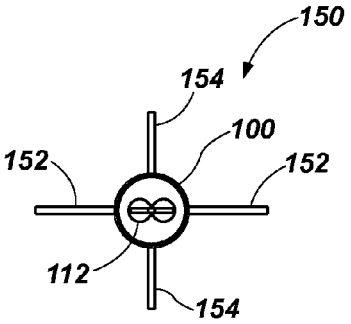
Figure 8D:
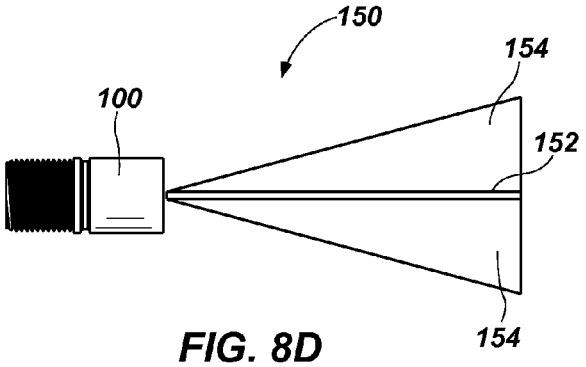
Figure 8E:
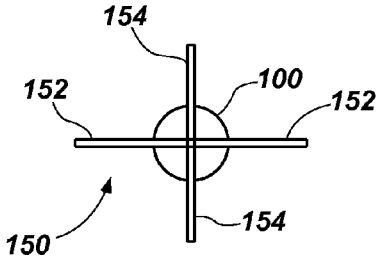

FIG. 7 is a rear perspective view of the embodiment of a nozzle 100 shown in FIGS. 1-6, according to the present invention. The intake port 112 formed in intake port end 110, opposing ridges 120 between the dual sub-chambers 114A and 114B, threading 106, circular sealing groove 108 and face 102 of nozzle 100 are also shown in FIG. 7.

Operation and fluid flow of nozzle 100 is described as follows: Pressurized fluid enters into the intake port 112 from a fixture or nozzle head (not shown) to which the nozzle 100 has been mated via threading 106. The fluid entering the intake port 112 then runs through the dual sub-chambers 114A and 114B toward the hemispherical impingement surfaces 118, where the laminar flow of the fluid is forced to impinge from above and below the slotted orifice 104 before exiting at high velocity as atomized fluid particles as a mist or cloud. Each of the dual sub-chambers 114A and 114B generates a flat jet spray pattern independently and along the plane of the slotted orifice 104. However, a particularly novel and unique feature of this dual sub-chambered nozzle 100 configuration is the interaction of the two independent flat jet fluid sprays which impinge against each other outside of the slotted orifice 104 and generate a vertical component to the spray pattern in addition to the horizontal component, the combination of which is referred to herein as a "dual vector" spray pattern.

This dual vector spray pattern is illustrated in FIGS. 8A-8E. More particularly, FIGS. 8A-8E are rear perspective, front perspective, rear, side and front views, respectively, of an exemplary composite peak spray density pattern 150 achieved by the embodiment of a dual sub-chambered fluid nozzle 100 shown in FIGS. 1-7, according to the present invention. As noted above, the dual sub-chambers 114A and 114B each generate a horizontal fluid spray pattern 152 in a plane containing the slotted orifice 104. Whereas, the interaction of the two independent flat jet fluid sprays adjacent to each other, which impinge against each other outside of the slotted orifice 104, generate a vertical component or vertical fluid spray pattern 204. The combination of the horizontal 152 and vertical 154 spray patterns is referred to herein as a "dual vector" spray pattern, which is believed to be unique and nonobvious in the art. Generally speaking, the dual vectored fluid nozzles disclosed herein, e.g., nozzle 100, have an exemplary composite peak spray density pattern 150 that is comprised of horizontal 152 and vertical 154 spray patterns that diverge radially in a direction away from the exit orifice.

The peak spray density patterns herein are all shown truncated after leaving the slotted orifice in order to illustrate horizontal and vertical (perpendicular) dual vector peak density spray patterns. It will be understood that the spray patterns will eventually disperse in atmosphere and form more random cloud or mist patterns the further away from the exit orifice. This is because the dual vector peak density spray patterns will eventually be acted upon by ambient air turbulence, friction against ambient air molecules or other objects, or disturbed by other forces that may act upon the fluid jets after exiting the nozzle.

Though the terms horizontal and vertical are used herein, it will be readily apparent to one of ordinary skill in the art that a horizontal spray pattern 152 may not necessarily coincide with gravitational horizontal. The same can be said for the vertical spray pattern 154 not necessarily coinciding with gravitational vertical. The key relationship between the horizontal 152 and vertical 154 spray patterns is that their peak spray densities are oriented perpendicular to one another as illustrated in FIGS. 8A-8E.

Figure 9:
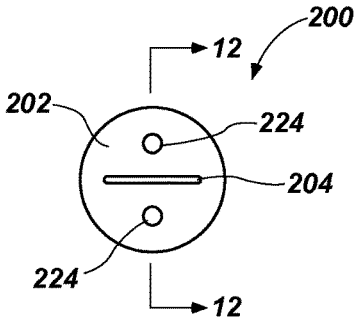
FIG. 9 is a front view of triple sub-chambered embodiment of a fluid nozzle, according to the present invention.

Referring now to FIGS. 9-15, an embodiment of a triple sub-chambered fluid nozzle 200 will be described. From FIGS. 9-15, it can be seen that nozzle 200 is generally cylindrical in nature. More particularly, FIG. 9 is a front view of triple sub-chambered embodiment of a fluid nozzle 300, according to the present invention. The cross-section of face 202 of nozzle 200 may be generally circular as shown in FIG. 9. However, other cross-sectional variations of face 202 (like face 102 discussed above) are contemplated, e.g., and not by way of limitation, square, pentagonal, hexagonal, octagonal, etc. and considered to be within the scope of the present invention.

Such other cross-sections may be particularly useful during installation and removal of the nozzle 100 from its fixture. For example square, hexagonal and octagonal shaped cross-sections at face 202 or located circumferentially anywhere between the face 202 and circular sealing groove 208, may readily mate with wrenches or other tools used to install and remove the nozzles 100 from a fixture (not shown). Such other cross-sections are intentionally not illustrated herein to simplify the numerous drawings. FIG. 9 further illustrates a slotted orifice 204 and pin spanner holes 224 in the face 202 of nozzle 200. The pin spanner holes 224 shown in FIGS. 9, 12 and 14 may be used with a pin spanner wrench or other similar tool to install or remove nozzle 200 from a nozzle head or other fixture to which is it mated using threads 206, according to one embodiment.

Figure 10:
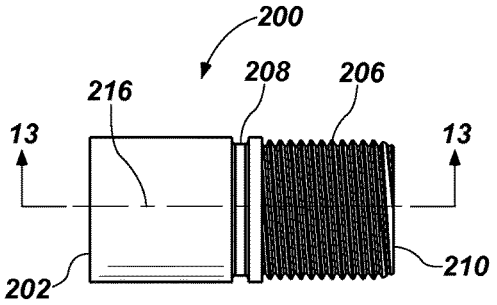
FIG. 10 is a right-side view of the embodiment shown in FIG. 9, according to the present invention.

FIG. 10 is a right-side view of the embodiment of fluid nozzle 200 shown in FIG. 9, according to the present invention. FIG. 10 shows threading 206 located along the intake port end 210 of nozzle 200 that is configured to mate with an opening or socket (not shown) in a suitable fixture, e.g., a water nozzle head (also not shown). FIG. 10 also illustrates a circular sealing groove 208 located circumferentially around nozzle 200 and located between the face 202 and intake port end 210. Circular sealing groove 208 is configured to receive an O-ring (not shown) used to form a water tight seal between the nozzle 200 and the fixture (not shown) to which the nozzle 200 is mated using threading 206. Threading 206 may be located between circular sealing groove 108 and intake port end 110, according to the illustrated embodiment.

Figure 11:
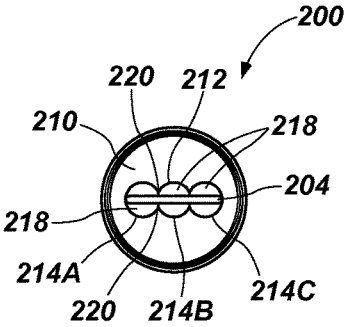
FIG. 11 is a rear view of the embodiment shown in FIGS. 9-10, according to the present invention.

FIG. 11 is a rear view of the embodiment of nozzle 200 shown in FIGS. 9-10, according to the present invention. From the rear view of nozzle 200, as shown in FIG. 11, the outline of the intake port 212 shows three sub-chambers 214A-C that may be bored into the nozzle 200 from the intake port end 210. The triple sub-chambers 214A-C may be formed parallel to one another by boring into nozzle 200 from the intake port end 210 in a direction parallel to the longitudinal axis 216 shown in dashed line in FIG. 10 and ending before reaching face 202 (see, e.g., FIGS. 9-10 and 12-13). Each of the triple sub-chambers 214A-C may be formed using a hemispherical boring tool (drill bit) that forms a hemispherical impingement surface (best shown in FIGS. 12-13 at reference 218 as discussed below) adjacent to the slotted orifice 204. The adjacent intersections of the triple sub-chambers 214A-C are opposing ridges 220 (two pairs) that are located between adjacent the triple sub-chambers 214A-C.

Figure 12:
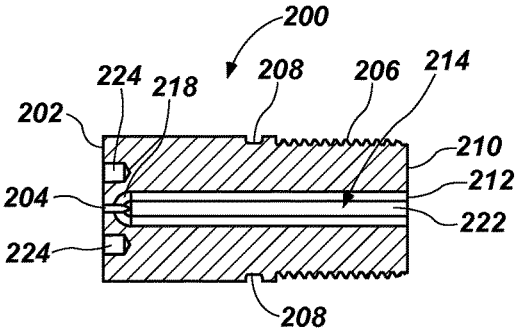
FIG. 12 is vertical section view of the embodiment shown in FIGS. 9-11 as indicated in FIG. 9, according to the present invention.

FIG. 12 is vertical section view as indicated in FIG. 9 of the embodiment of nozzle 200 shown in FIGS. 9-11, according to the present invention. FIG. 12 illustrates the threading 206 and circular sealing groove 208 also shown in FIGS. 10 and 13-15. FIG. 12 further illustrates a gap 222 between the opposing ridges 220 shown in FIGS. 11 and 15. The gap 222 begins at the intake port end 210 and ends at the slotted orifice 204 before reaching the face 202. The fluid chamber, shown generally at arrow 214, comprises the combination of all three of the triple sub-chambers 214A-C.

Figure 13:
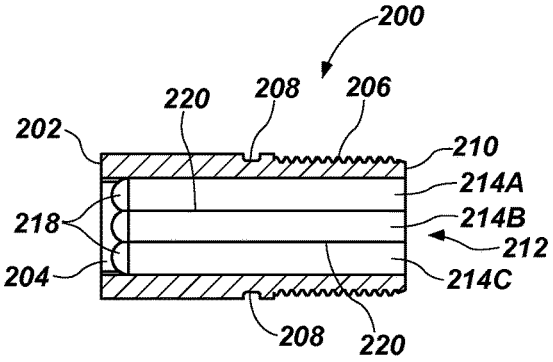
FIG. 13 is horizontal section view of the embodiment shown in FIGS. 9-12 as indicated in FIG. 10, according to the present invention.

FIG. 13 is horizontal section view as indicated in FIG. 10 of the embodiment of nozzle 200 shown in FIGS. 9-12, according to the present invention. FIG. 13 illustrates the generally elongated cylindrical shape of the triple sub-chambers 214A-C and the hemispherical impingement surfaces 218 of the triple sub-chambers 214A-C adjacent to slotted orifice 204. Opposing ridges 220 appear as lines running longitudinally in FIG. 13. FIG. 13 also illustrates the threading 206 and circular sealing groove 208 of nozzle 200.

Figure 14:
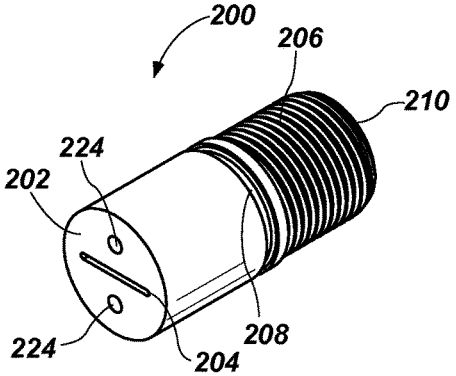
FIG. 14 is a front perspective view of the embodiment shown in FIGS. 9-13, according to the present invention.

FIG. 14 is a front perspective view of the embodiment of nozzle 200 shown in FIGS. 9-13, according to the present invention. The face 202, slotted orifice 204, pin spanner holes 224 (two shown), circular sealing groove 208, threading 206 and intake port end 210 of nozzle 200 are shown in FIG. 14.

Figure 15:
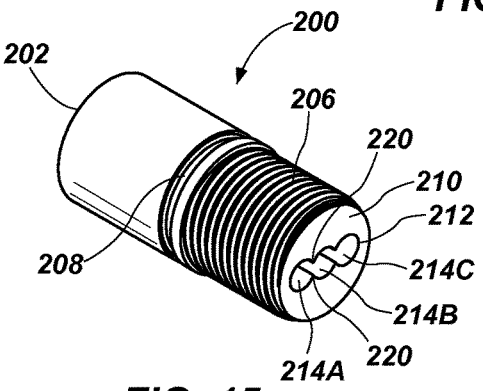
FIG. 15 is a rear perspective view of the embodiment shown in FIGS. 9-14, according to the present invention.
Figure 16A:
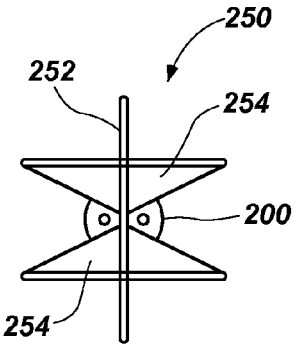
FIGS. 16A-16F are rotated front, top, front perspective, front, side and rear views, respectively, of an exemplary peak spray density pattern achieved by the embodiment of a fluid nozzle shown in FIGS. 9-15, according to the present invention.
Figure 16B:
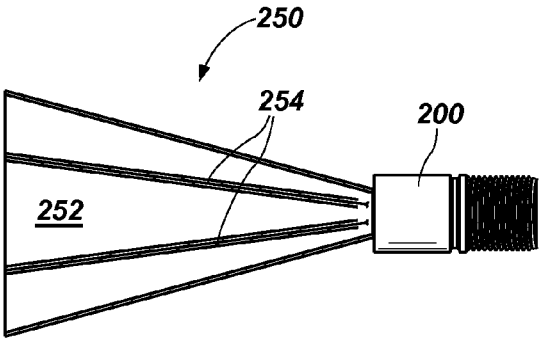
Figure 16C:
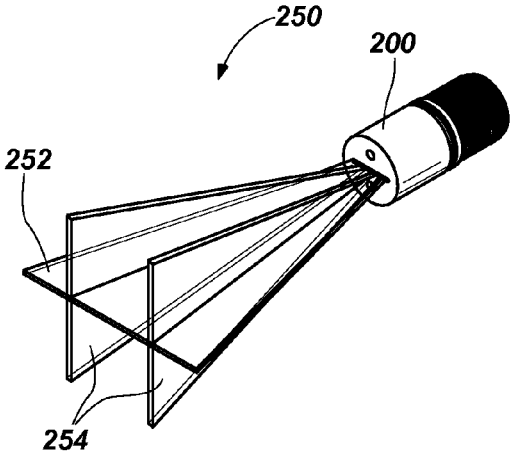
Figure 16D:
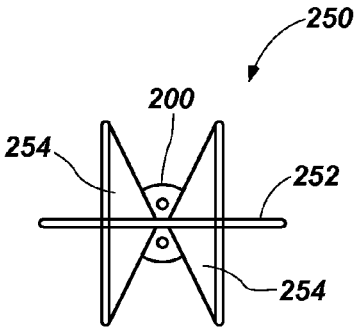
Figure 16E:
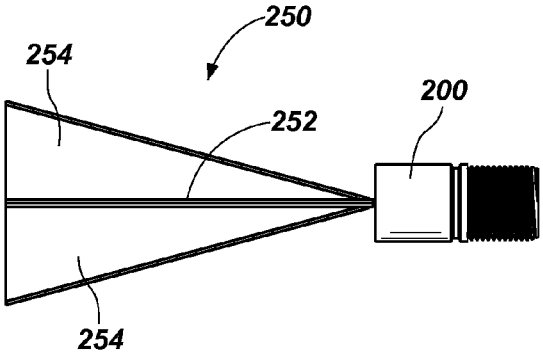
Figure 16F:
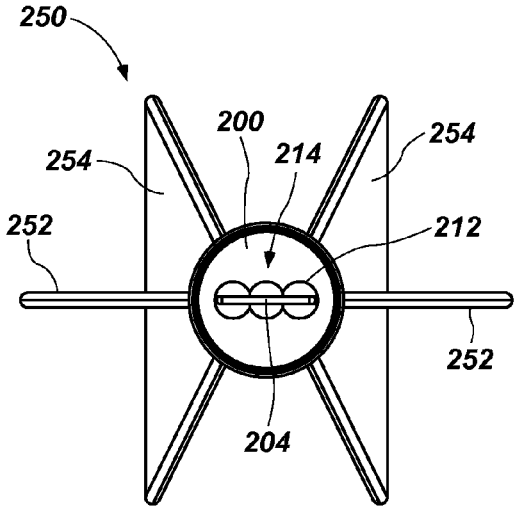

FIG. 15 is a rear perspective view of the embodiment of nozzle 200 shown in FIGS. 9-14, according to the present invention. The intake port 212 formed in intake port end 210, opposing ridges 220 between the triple sub-chambers 214A-C, threading 206, circular sealing groove 208 and face 202 of nozzle 200 are also shown in FIG. 15.

FIGS. 16A-16F are rotated front, top, front perspective, front, side and rear views, respectively, of an exemplary composite peak spray density pattern 250 achieved by the embodiment of a fluid nozzle 200 shown in FIGS. 9-15, according to the present invention. Each of the triple sub-chambers 214A-C will generate an independent flat jet spray pattern exiting from the slotted orifice 204 in a horizontal spray pattern 252 largely in a plane that includes the slotted orifice 204. Further and uniquely to the embodiments of dual vectored nozzles disclosed herein, the interference caused by the intersection of those horizontally oriented spray patterns 152 will generate vertically oriented spray patterns 254. Again, the terms horizontal and vertical are not necessarily referenced to gravitational horizontal and vertical, but are simply perpendicular relative to one another. The naming convention used herein is to associate the term horizontal with a plane including the slotted orifice 204 and vertical with spray densities that are generally perpendicular to the plane including the slotted orifice 204. It will be understood that the nozzles disclosed herein may be oriented in any suitable direction for any suitable purpose.

Accordingly, FIGS. 16A-F illustrate an exemplary composite dual vector spray pattern shown generally at arrow 250 and generated by nozzle 200 that is comprised of a horizontal spray pattern 252 and two vertical spray patterns 254. Note that the vertical spray patterns 254 are oriented generally perpendicular to the horizontal spray pattern 252. The origination of each of the two vertical spray patterns 254 corresponds to the intersections of flat jet spray patterns from adjacent sub-chambers 214A-C. The two vertical spray patterns 254 may also roughly correspond to the two opposed pairs of ridges 220 formed within the fluid chamber, shown generally at arrow 214 in FIGS. 12 and 16F, comprising all three sub-chambers 214A-C.

Referring now to FIGS. 17-23, an embodiment of a triple-chambered fluid nozzle 300 is shown in various views. Nozzle 300 shares the triple sub-chambered fluid chamber 214 structure illustrated and described with reference to nozzle 200 above. However, nozzle 300 further includes two additional triple sub-chambered fluid chambers 314, one displaced vertically above and one displaced vertically below fluid chamber 214, and each fluid chamber 314 having smaller dimensions than fluid chamber 214. Since the fluid chambers 214 and 314 have generally the same structure and operation as fluid chamber 214 of nozzle 200, the focus of the discussion below with respect to nozzle 300 will be on the distinctive new features, or differences, of the structure and resulting fluid spray patterns relative to nozzles 100 and 200 disclosed above.

Figure 17:
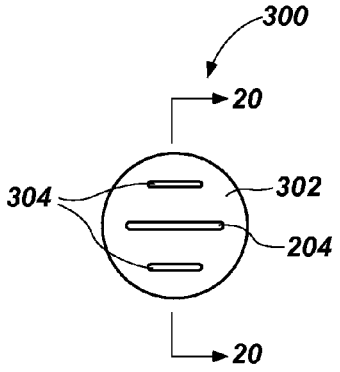
FIG. 17 is a front view of triple-chambered embodiment of a fluid nozzle, according to the present invention.

FIG. 17 is a front view of an embodiment of a triple-chambered fluid nozzle 300, according to the present invention. As shown in FIG. 17, face 302 includes main slotted orifice 204 and two smaller slotted orifices 304, vertically displaced above and below the main slotted orifice 204 along the dashed line indicated for the cross-sectional view in FIG. 20. Note that unlike nozzle 200, there are no pin spanner holes 224 formed in the face 302 of nozzle 300, because that is where the smaller slotted orifices 304 reside.

Figure 18:
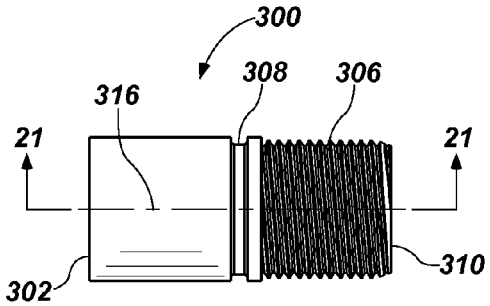
FIG. 18 is a right-side view of the embodiment shown in FIG. 17, according to the present invention.

FIG. 18 is a right-side view of the embodiment of nozzle 300 shown in FIG. 17, according to the present invention. Like other nozzle embodiments, nozzle 300 may include threading 306 and circular sealing groove 308 located between face 302 and intake port end 310 of nozzle 300. The view of nozzle 300 in FIG. 18 is essentially identical to the view of nozzle 200 in FIG. 10.

Figure 19:
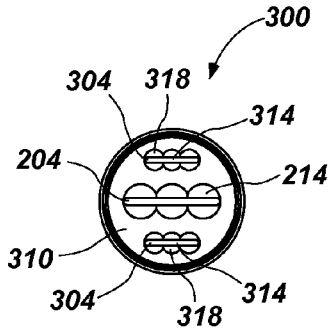
FIG. 19 is a rear view of the embodiment shown in FIGS. 17-18, according to the present invention.

FIG. 19 is a rear view of the embodiment of nozzle 300 shown in FIGS. 17-18, according to the present invention. FIG. 19 clearly shows the three independent fluid chambers, namely the center fluid chamber 214 and the vertically disposed smaller fluid chambers 314, each with its respective slotted orifices, 204 and 304. Thus, nozzle 300 may be capable of independent driving of each of the three fluid chambers 214 and 314 using appropriate valving (not shown) in the fixture to which the nozzle 300 is affixed by threading 306.

Figure 20:
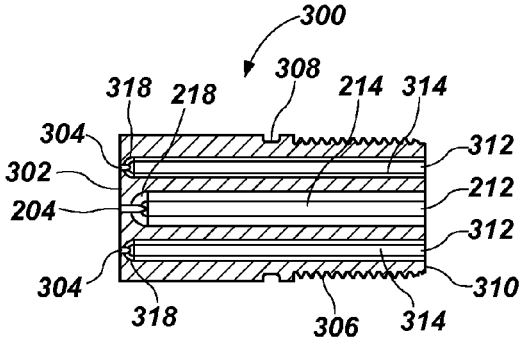
FIG. 20 is vertical section view of the embodiment shown in FIGS. 17-19 as indicated in FIG. 17, according to the present invention.

FIG. 20 is vertical section view as indicated in FIG. 17 of the embodiment of nozzle 300 shown in FIGS. 17-19, according to the present invention. FIG. 20 illustrates each of the three fluid chambers 214 (one main fluid chamber) and 314 (two smaller fluid chambers) in cross-section. Each of the three fluid chambers 214 (one main fluid chamber) and 314 (two smaller fluid chambers) is configured to receive pressurized fluid at the intake port end 310 at each respective intake port 212 and 312. In operation, the pressurized fluid may be driven through each of the three fluid chambers 214 (one main fluid chamber) and 314 (two smaller fluid chambers) until the laminar flow of the fluid is forced to impinge at the hemispherical impingement surfaces 218 and 318 (two smaller impingement surfaces associated with smaller fluid chambers 314) before exiting a respective slotted orifices 204 and 304 (two smaller slotted orifices).

Figure 21:
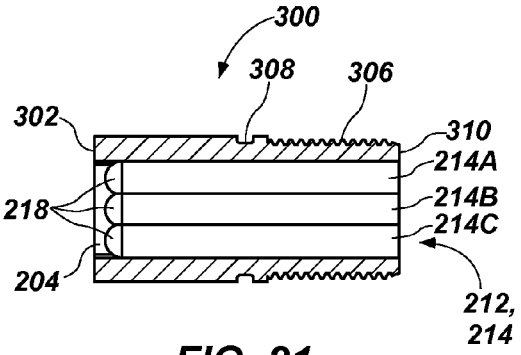
FIG. 21 is horizontal section view of the embodiment shown in FIGS. 17-20 as indicated in FIG. 18, according to the present invention.

FIG. 21 is horizontal section view as indicated in FIG. 18 of the embodiment of nozzle 300 shown in FIGS. 17-20, according to the present invention. Note that the view of nozzle 300 shown in FIG. 21 is essentially identical to the view of nozzle 200 shown in FIG. 13, because they both are section views of the same triple sub-chambered fluid chamber 214.

Figure 22:
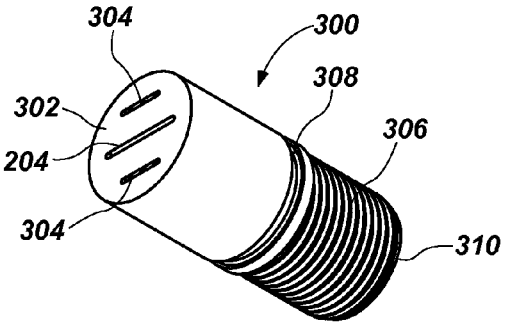
FIG. 22 is a front perspective view of the embodiment shown in FIGS. 17-21, according to the present invention.

FIG. 22 is a front perspective view of the embodiment of nozzle 300 shown in FIGS. 17-21, according to the present invention. The face 302, main slotted orifice 204, both smaller slotted orifices 304, circular sealing groove 308, threading 306 and intake port end 310 of nozzle 300 are shown in FIG. 22.

Figure 23:
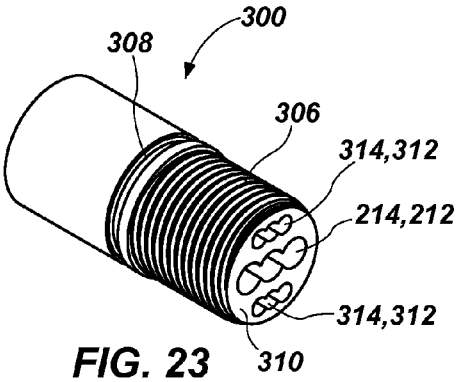
FIG. 23 is a rear perspective view of the embodiment shown in FIGS. 17-22, according to the present invention.
Figure 24A:
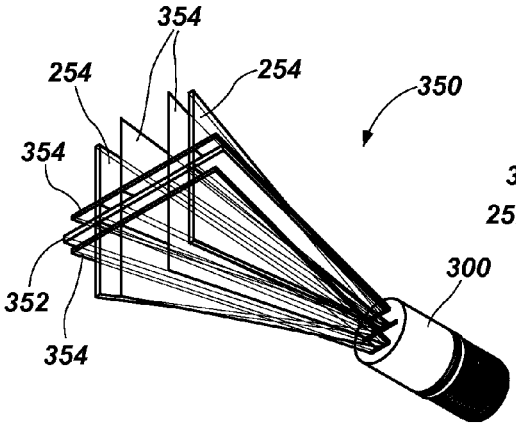
FIGS. 24A-24E are front perspective, rear perspective, front, side and rear views, respectively, of an exemplary peak spray density pattern achieved by the embodiment of a fluid nozzle shown in FIGS. 17-23, according to the present invention.
Figure 24B:
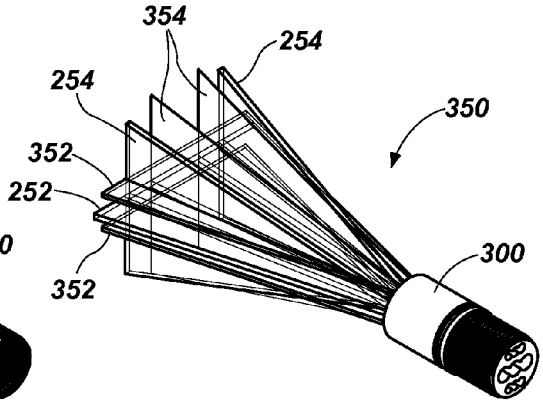
Figure 24C:
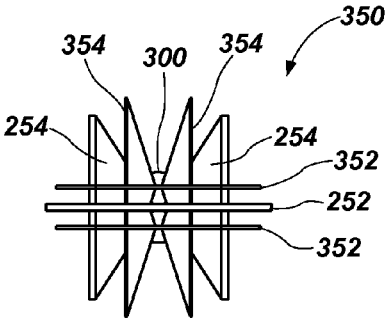
Figure 24D:
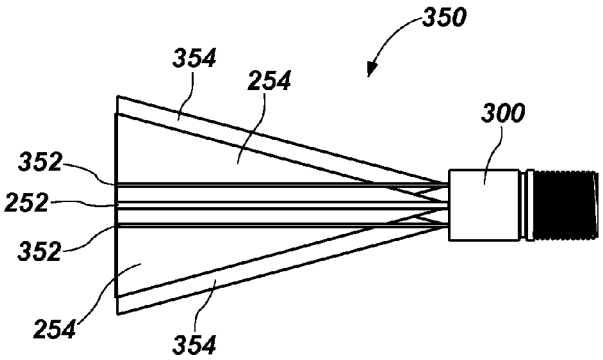
Figure 24E:
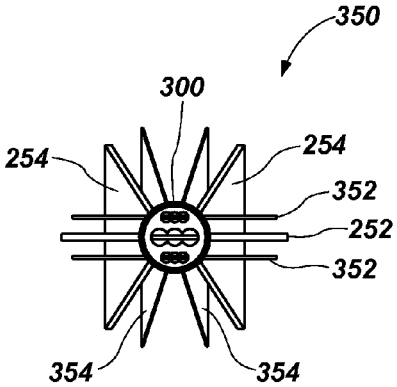

FIG. 23 is a rear perspective view of the embodiment of nozzle 300 shown in FIGS. 17-22, according to the present invention. The intake port 212 formed in intake port end 310, and main fluid chamber 214 are essentially identical to those shown in FIG. 15. The two smaller fluid chambers 314 having smaller intake ports 312 formed in the intake port end 310 are also shown in FIG. 23, along with the threading 306 and circular sealing (O-ring) groove 308.

FIGS. 24A-24E are front perspective, rear perspective, front, side and rear views, respectively, of an exemplary composite peak spray density pattern 350 achieved by the embodiment of a fluid nozzle 300 shown in FIGS. 17-23, according to the present invention. The composite peak spray density pattern 350 shown in FIGS. 24A-24E include the supposition of the spray patterns originating from each of the two smaller slotted orifices 304 with the spray patterns show for the main orifice 204 illustrated in FIGS. 16A-16F. Each of the fluid chambers 214 (main chamber) and 314 (two smaller chambers) will generate a single horizontal spray with two vertical spray patterns. More particularly, the vertical components of the two smaller slotted orifices 304 will be along the same two vertical planes 354 inside of the two vertical planes 254 generated by the main slotted orifice 204, because of the smaller geometry associated with the smaller slotted orifices. Note that the horizontal components 252 (one associated with main slotted orifice 204) and 352 (two, one each associated with each smaller slotted orifice) all fall along planes containing their respective slotted orifices 204 and 304.

From a comparison of the spray patterns (FIGS. 16A-16F) generated by nozzle 200 to the spray patterns (FIGS. 24A-24E) generated by nozzle 300, the increased fluid spray density becomes visually apparent with the more fluid chambers and slotted orifices. Thus, knowledge about the resulting spray patterns from various nozzle configurations may be configured to generate virtually unlimited fluid peak density spray patterns. Additional such combinations and configurations are shown and described below.

For example, suppose one started with the triple sub-chambered fluid chamber 214 of nozzle 200 and superimposed the same triple sub-chambered fluid chamber 214 rotated 90° about the longitudinal axis 216. The resulting fluid chamber 414 would include a quintuple sub-chambered embodiment of a fluid nozzle with cross-slotted exit orifice according to the present invention as shown in FIGS. 25-31 and as described further below.

Figure 25:
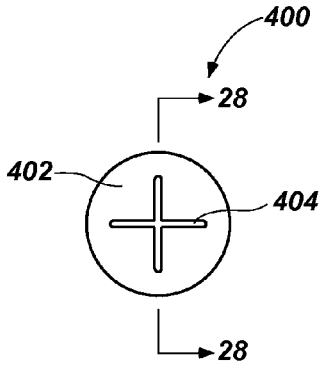
FIG. 25 is a front view of cross-slotted, quintuple sub-chambered embodiment of a fluid nozzle, according to the present invention.

FIG. 25 is a front view of such a cross-slotted, quintuple sub-chambered embodiment of a fluid nozzle 400, according to the present invention. More particularly, FIG. 25 illustrates an embodiment of a cross-slotted orifice 404 in face 402 of nozzle 400.

Figure 26:
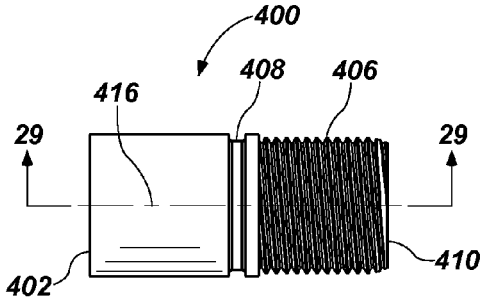
FIG. 26 is a right-side view of the embodiment shown in FIG. 25, according to the present invention.

FIG. 26 is a right-side view of the embodiment of nozzle 400 shown in FIG. 25, according to the present invention. More particularly, FIG. 26 illustrates the threading 406, located between circular sealing groove 408 and intake port end 410 (opposite face 402). Groove 408 is configured to receive an O-ring (not shown) for sealing nozzle 400 to a fixture (not shown) using threading 406. The longitudinal axis 416 shown in dashed line in FIG. 26 is also the section view line for FIG. 29, described below.

Figure 27:
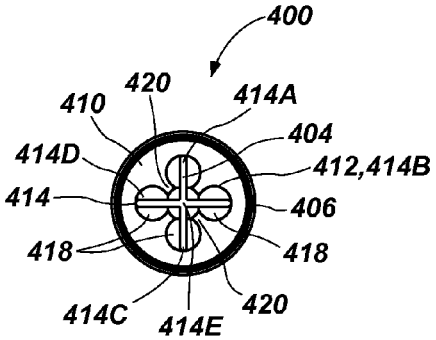
FIG. 27 is a rear view of the embodiment shown in FIGS. 25-26, according to the present invention.

FIG. 27 is a rear view of the embodiment of nozzle 400 shown in FIGS. 25-26, according to the present invention. More particularly, FIG. 27 illustrates an embodiment of a cloverleaf intake port 412 leading into cloverleaf cross-sectioned fluid chamber 414, comprised of five sub-chambers 414A-E, then to hemispherical impingement surfaces 418 (five smaller circular objects) that force laminar fluid flows from internal surfaces of the fluid chamber 414 to impinge against each other before exiting as atomized fluid particles at the cross-slotted orifice 404. Note that there are four ridges 420 between each "leaf" of the cloverleaf configuration separating the four outer sub-chambers 414A-D.

Figure 28:
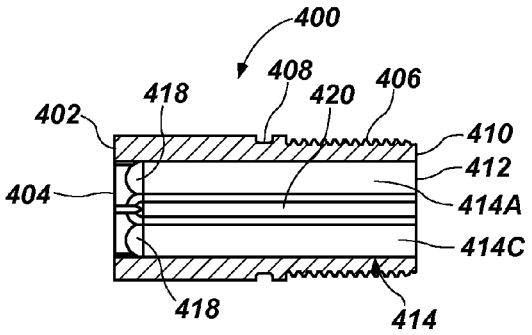
FIG. 28 is vertical section view of the embodiment shown in FIGS. 25-27 as indicated in FIG. 25, according to the present invention.

FIG. 28 is vertical section view as indicated in FIG. 25 of the embodiment of nozzle 400 shown in FIGS. 25-27, according to the present invention. More particularly, FIG. 28 illustrates from the intake port end 410 toward face 402 the following features: intake port 412, two sub-chambers 414A and 414C separated by ridge 420, leading to hemispherical impingement surfaces 418 adjacent to the cross-slotted exit orifice 404. FIG. 28 also illustrates threading 406 and groove 408 in cross-section.

Figure 29:
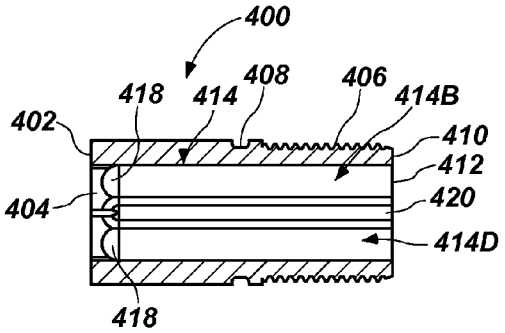
FIG. 29 is horizontal section view of the embodiment shown in FIGS. 25-28 as indicated in FIG. 26, according to the present invention.

FIG. 29 is horizontal section view as indicated in FIG. 26 of the embodiment of nozzle 400 shown in FIGS. 25-28, according to the present invention. The cross-section view shown in FIG. 29 appears essentially identical to the cross-section view of FIG. 28. This is because of symmetry about the longitudinal axis 416 (FIG. 26). More particularly, FIG. 29 illustrates two different sub-chambers, i.e., sub-chambers 414B and 414D separated by ridge 420.

Figure 30:
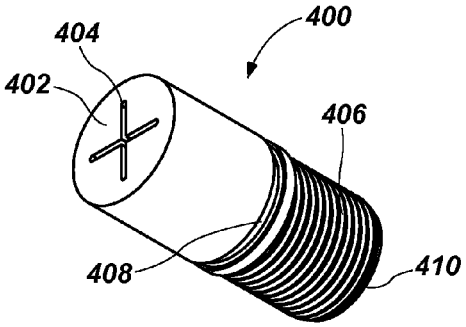
FIG. 30 is a front perspective view of the embodiment shown in FIGS. 25-29, according to the present invention.

FIG. 30 is a front perspective view of the embodiment of nozzle 400 shown in FIGS. 25-29, according to the present invention. More particularly, FIG. 30 illustrates the cross-slotted orifice 404 on face 402, threading 406 located between groove 408 and intake port end 410.

Figure 31:
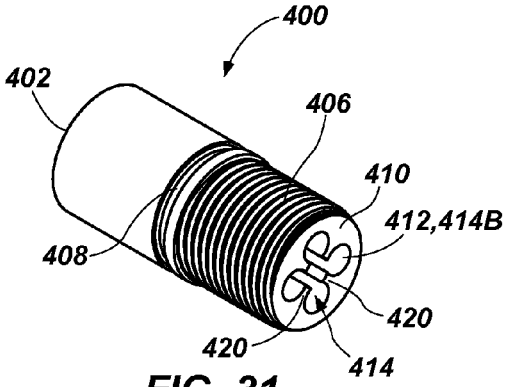
FIG. 31 is a rear perspective view of the embodiment shown in FIGS. 25-30, according to the present invention.

FIG. 31 is a rear perspective view of the embodiment of nozzle 400 shown in FIGS. 25-30, according to the present invention. More particularly, FIG. 31 illustrates threading 406 located between circular sealing groove 408 and intake port end 410, intake port 412, cloverleaf cross-sectioned fluid chamber 414 with five sub-chambers 414A-E and four ridges 420.

Figure 32A:
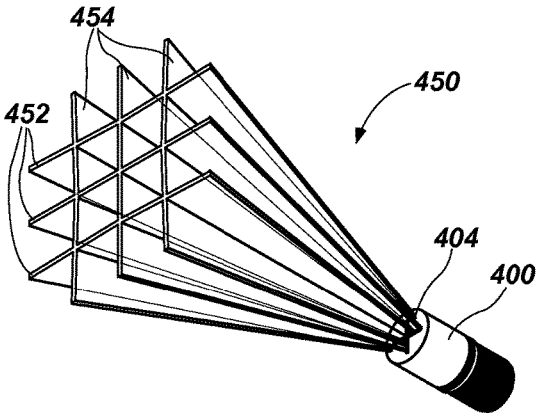
FIGS. 32A-32F are front perspective, top, rear perspective, front, side and rear views, respectively, of an exemplary peak spray density pattern achieved by the embodiment of a fluid nozzle shown in FIGS. 25-31, according to the present invention.
Figure 32B:
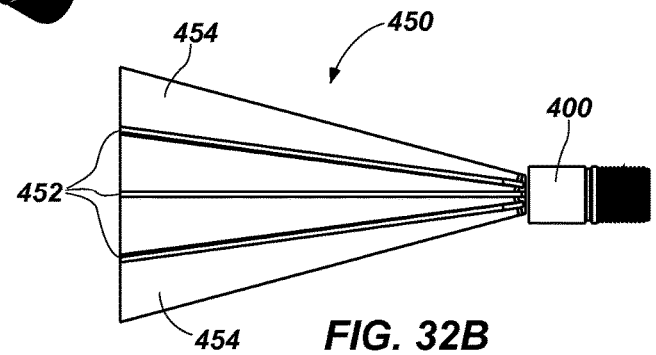
Figure 32C:
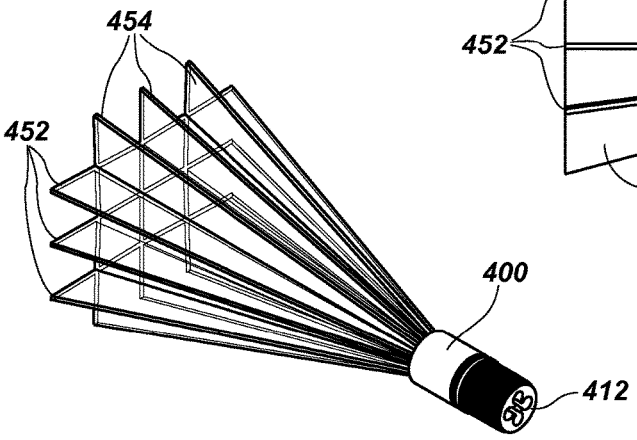
Figure 32D:
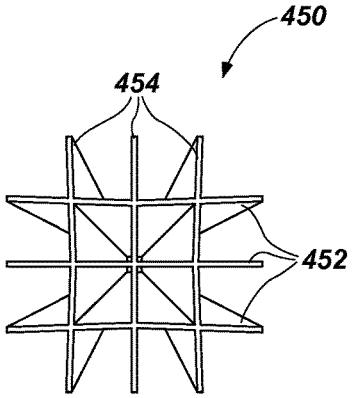
Figure 32E:
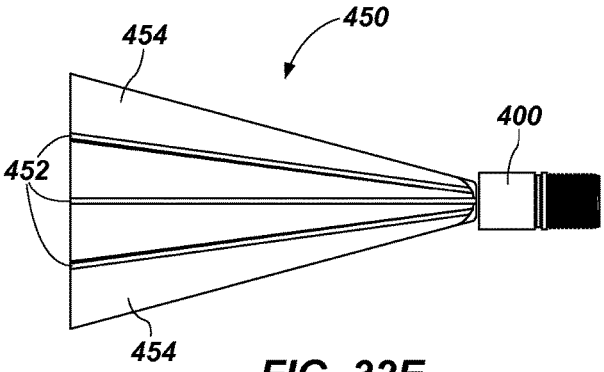
Figure 32F:
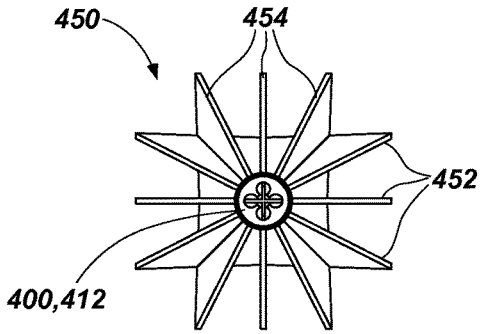

FIGS. 32A-24F are front perspective, top, rear perspective, front, side and rear views, respectively, of an exemplary composite peak spray density pattern 450 achieved by the embodiment of a fluid nozzle 400 shown in FIGS. 25-31, according to the present invention. The composite peak spray density pattern 450 is characterized by three horizontal spray patterns 452 and three vertical spray patterns 454, which is generally homogeneous in both the horizontal and vertical directions.

FIGS. 33-39 illustrate yet another embodiment of a triple-slotted, quintuple sub-chambered fluid nozzle 500, according to the present invention. Nozzle 500 employs the cloverleaf cross-sectioned fluid chamber (see 414) configuration of nozzle 400 described above, but with a triple slotted exit orifice configuration similar to nozzle 300.

Figure 33:
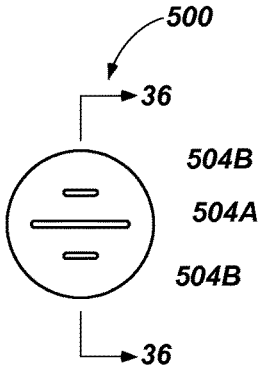
FIG. 33 is a front view of triple-slotted, quintuple sub-chambered embodiment of a fluid nozzle, according to the present invention.

More particularly, FIG. 33 is a front view of triple-slotted, quintuple sub-chambered embodiment of a fluid nozzle 500, according to the present invention. FIG. 33 illustrates main slotted orifice 504A and two vertically offset smaller slotted orifices 504B formed in face 502.

Figure 34:
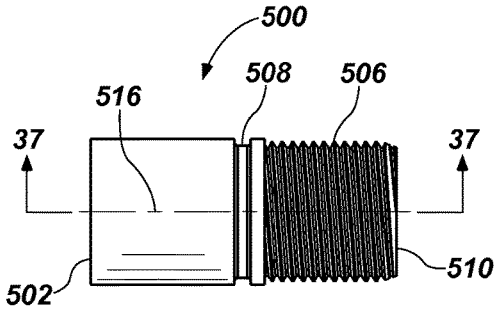
FIG. 34 is a right-side view of the embodiment shown in FIG. 33, according to the present invention.

FIG. 34 is a right-side view of the embodiment of nozzle 500 shown in FIG. 33, according to the present invention. More particularly, FIG. 34 illustrates threading 506, located between circular sealing groove 508 and intake port end 510

(opposite face 502). Groove 508 is configured to receive an O-ring (not shown) for sealing nozzle 500 to a fixture (not shown) using threading 506. The longitudinal axis 516 shown in dashed line in FIG. 34 is also the section view line for FIG. 37, described in further detail below.

Figure 35:
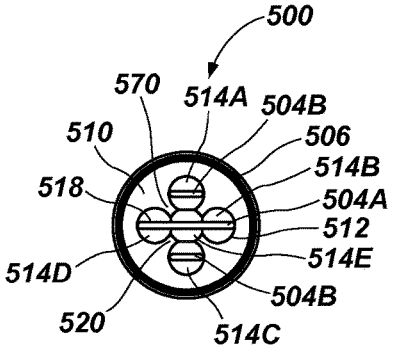
FIG. 35 is a rear view of the embodiment shown in FIGS. 33-34, according to the present invention.

FIG. 35 is a rear view of the embodiment of nozzle 500 shown in FIGS. 33-34, according to the present invention. More particularly, FIG. 35 illustrates cloverleaf intake port 512 leading into the cloverleaf cross-sectioned fluid chamber 514 comprising a central sub-chamber 514E and four sub-chambers 514A-D in a cloverleaf cross-section configuration leading to hemispherical impingement surfaces 518. The four sub-chambers 514A-D divided by ridges 520. Pressurized fluid flowing from a fixture (not shown) into intake port 512 and into chamber 514 impinges along the hemispherical impingement surfaces 518 before exiting the main slotted orifice 504A and the two smaller slotted orifices 504B as atomized fluid particles.

Figure 36:
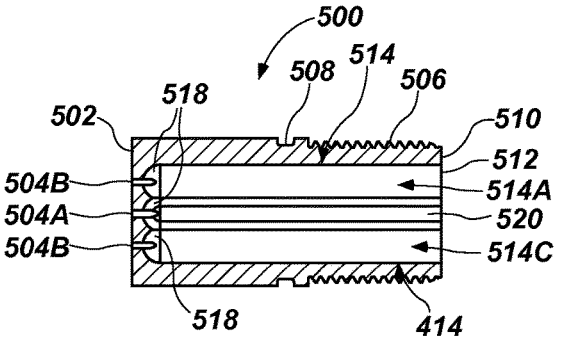
FIG. 36 is vertical section view of the embodiment shown in FIGS. 33-35 as indicated in FIG. 33, according to the present invention.

FIG. 36 is vertical section view as indicated in FIG. 33 of the embodiment of nozzle 500 shown in FIGS. 33-35, according to the present invention. More particularly, FIG. 36 illustrates two sub-chambers 514A and 514B in cross-section divided by ridge 520 in nozzle 500. FIG. 36 further illustrates the hemispherical impingement surfaces 518 adjacent the main slotted orifice 504A and the two smaller slotted orifices 504B.

Figure 37:
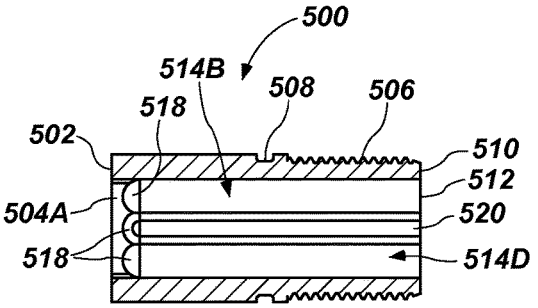
FIG. 37 is horizontal section view of the embodiment shown in FIGS. 33-36 as indicated in FIG. 34, according to the present invention.

FIG. 37 is horizontal section view of the embodiment of nozzle 500 shown in FIGS. 33-36 as indicated in FIG. 34, according to the present invention. More particularly, FIG. 37 illustrates two sub-chambers 514A and 514C in cross-section divided by ridge 520. FIG. 37 illustrates the hemispherical impingement surfaces 518 adjacent the main slotted orifice 504A.

Figure 38:
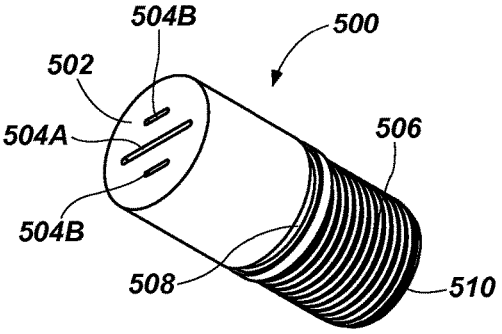
FIG. 38 is a front perspective view of the embodiment shown in FIGS. 33-37, according to the present invention.

FIG. 38 is a front perspective view of the embodiment of nozzle 500 shown in FIGS. 33-37, according to the present invention. More particularly, FIG. 38 illustrates main slotted orifice 504A and two smaller slotted orifices 504B disposed in face 502, with threading 506 between O-ring groove 508 and intake port end 510 of nozzle embodiment 500.

Figure 39:
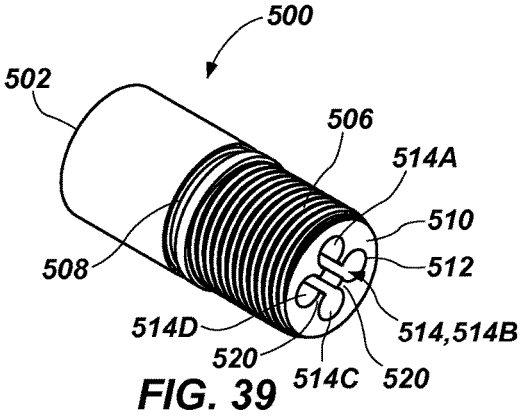
FIG. 39 is a rear perspective view of the embodiment shown in FIGS. 33-38, according to the present invention.
Figure 40A:
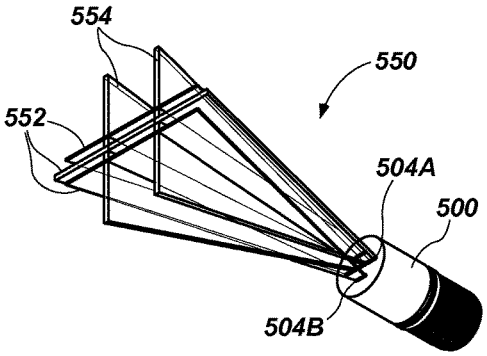
FIGS. 40A-40F are front perspective, top, rear perspective, front, side and rear views, respectively, of an exemplary peak spray density pattern achieved by the embodiment of a fluid nozzle shown in FIGS. 33-39, according to the present invention.
Figure 40B:
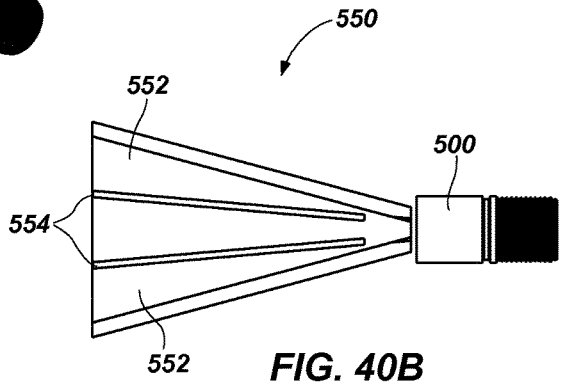
Figure 40C:
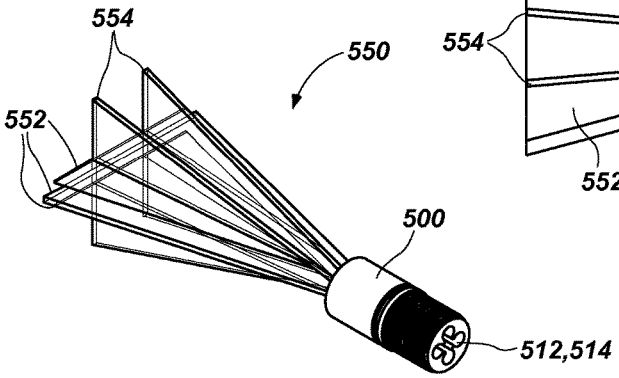
Figure 40D:
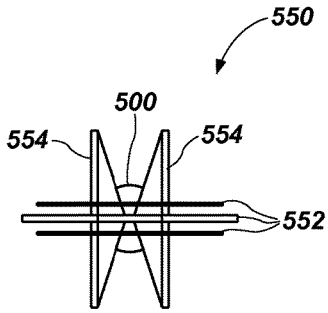
Figure 40E:
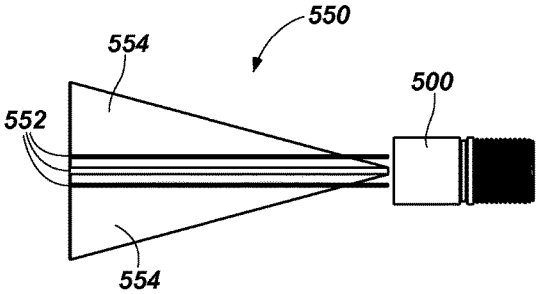
Figure 40F:
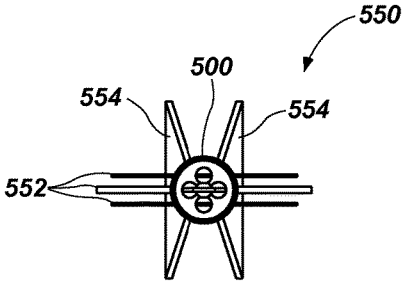

FIG. 39 is a rear perspective view of the embodiment of nozzle 500 shown in FIGS. 33-38, according to the present invention. More particularly, FIG. 39 illustrates the cloverleaf cross-sectioned intake port 512 leading into cloverleaf cross-sectioned fluid chamber 514 of nozzle embodiment 500. FIG. 39 further illustrates ridges between sub-chambers 514A-D. Finally, FIG. 39 illustrates threading 506 adjacent to O-ring groove 508 of nozzle embodiment 500.

FIGS. 40A-40F are front perspective, top, rear perspective, front, side and rear views, respectively, of an exemplary dual vector composite peak spray density pattern 550 (hereinafter "composite spray pattern 550") achieved by the embodiment of a fluid nozzle 500 shown in FIGS. 33-39, according to the present invention. The composite dual vector fluid spray pattern 550 generated by nozzle embodiment 500 includes three closely spaced horizontal peak spray patterns 552, each corresponding to one of the three slotted orifices 504A and 504B. Composite spray pattern 550 further includes two vertically oriented peak spray patterns 554. Composite spray pattern 550 is characterized by a dual vectored spray pattern that has particularly high density along the closely placed planes that comprise the horizontal peak spray patterns 552.

It will be understood that additional variations in the structure of the novel nozzles disclosed herein can be used to shape the resultant composite fluid spray pattern. For example, by chamfering of opposed orifice edges, or using flattened oval cross-sectioned orifices, or both, can be employed to achieve flat jets of atomized fluid. FIGS. 41-47 illustrate a particular embodiment with these types of structural enhancements, namely, a single-slotted, quintuple sub-chambered, dual flat jet embodiment of a fluid nozzle 600, according to the present invention.

Figure 41:
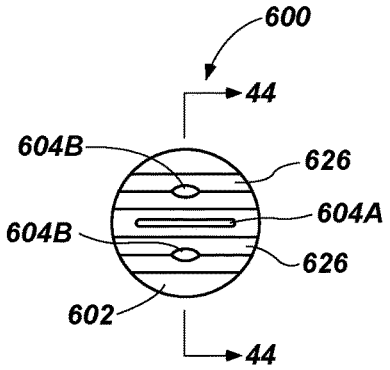
FIG. 41 is a front view of single-slotted, quintuple sub-chambered, dual flat jet embodiment of a fluid nozzle, according to the present invention.

FIG. 41 is a front view of a single-slotted, quintuple sub-chambered, dual flat jet embodiment of a fluid nozzle 600, according to the present invention. FIG. 41 illustrates a slotted orifice 604A and two flattened oval cross-sectioned orifices 604B disposed in face 602 of nozzle 600. Note that the opposing edges of the two oval orifices 604B are chamfered 626 along the face 602 of nozzle embodiment 600.

Figure 42:
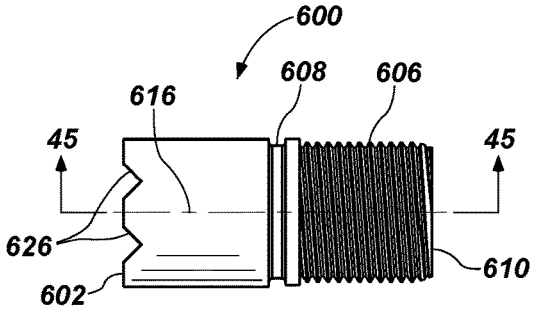
FIG. 42 is a right-side view of the embodiment shown in FIG. 41, according to the present invention.

FIG. 42 is a right-side view of the embodiment shown in FIG. 41, according to the present invention. More particularly, FIG. 42 illustrates chamfers 626 formed in face 602, circular sealing (O-ring) groove 608, threading 606 and intake port end 610. Longitudinal axis, shown as dashed line 616, passes through the cylindrical axis of nozzle 600 and is also the cut-line for the section shown FIG. 45.

Figure 43:
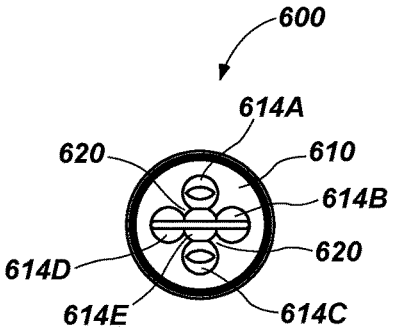
FIG. 43 is a rear view of the embodiment shown in FIGS. 41-42, according to the present invention.

FIG. 43 is a rear view of the embodiment shown in FIGS. 41-42, according to the present invention. More particularly, FIG. 43 illustrates the clover leaf cross-sectioned intake port 612 and fluid chamber 614. Clover leaf cross-sectioned fluid chamber 614 is of the quintuple sub-chamber 614A-E configuration. Sub-chambers 614A-D are divided by ridges 620. Towards the face 602 end, there are hemispherical impingement surfaces 618 which are adjacent to the slotted orifice 604A and the two flattened oval cross-sectioned orifices 604B.

Figure 44:
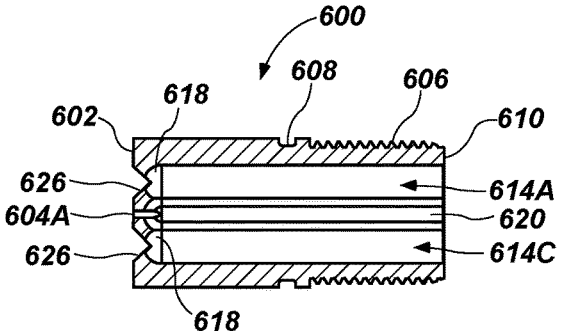
FIG. 44 is vertical section view of the embodiment shown in FIGS. 41-43 as indicated in FIG. 41, according to the present invention.

FIG. 44 is vertical section view of the embodiment shown in FIGS. 41-43 as indicated in FIG. 41, according to the present invention. More particularly, FIG. 44 illustrates a cross-section through fluid chamber 614 and sub-chambers 614A and 614C separated by ridge 620, of nozzle embodiment 600. At the face 602 of nozzle embodiment 600, chamfers 626 are shown cutting into hemispherical impingement surfaces 618 associated with sub-chambers 614A and 614C. FIG. 44 further illustrates a cross-section of slotted orifice 604A, threading 606 and circular sealing (O-ring) groove 608 of nozzle embodiment 600.

Figure 45:
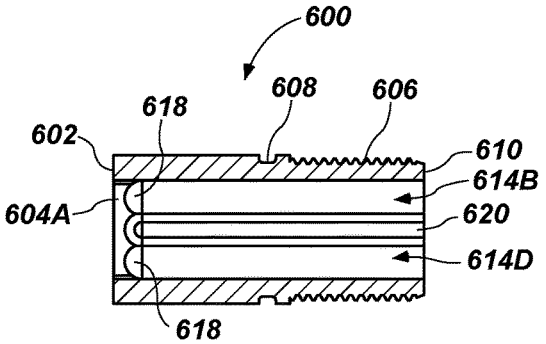
FIG. 45 is horizontal section view of the embodiment shown in FIGS. 41-44 as indicated in FIG. 42, according to the present invention.

FIG. 45 is horizontal cross-section view as indicated in FIG. 42 of the embodiment shown in FIGS. 41-44, according to the present invention. More particularly, FIG. 45 illustrates two sub-chambers 614B and 614D separated by ridge 620, of nozzle embodiment 600. The hemispherical impingement surfaces 618 are adjacent to slotted orifice 604A on face 602 of nozzle embodiment 600. FIG. 45 further illustrates threading 606 and circular sealing (O-ring) groove 608 of nozzle embodiment 600.

Figure 46:
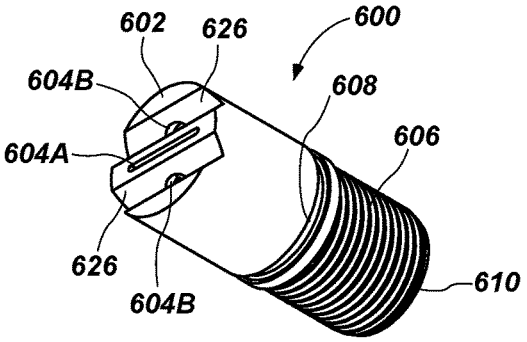
FIG. 46 is a front perspective view of the embodiment shown in FIGS. 41-45, according to the present invention.

FIG. 46 is a front perspective view of the embodiment shown in FIGS. 41-45, according to the present invention. More particularly, FIG. 46 illustrates chamfers 626 cut into face 602 and flattened oval cross-sectioned orifices 604B as well as slotted orifice 604A. FIG. 46 further illustrates threading 606 and circular sealing (O-ring) groove 608 of nozzle embodiment 600.

Figure 47:
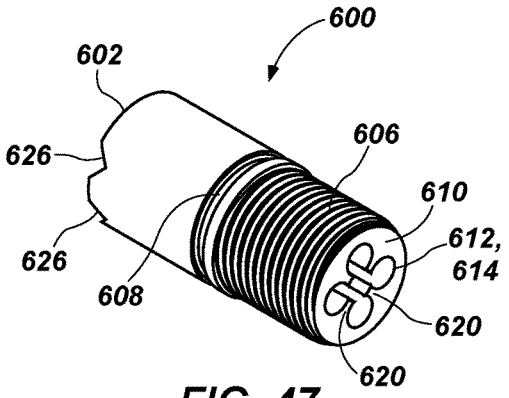
FIG. 47 is a rear perspective view of the embodiment shown in FIGS. 41-46, according to the present invention.
Figure 48A:
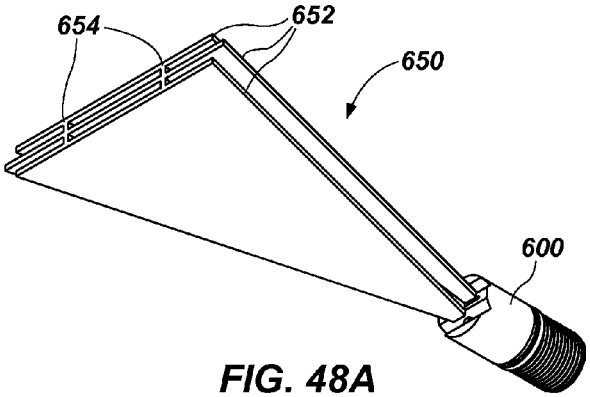
FIGS. 48A-48F are front perspective, top, rear perspective, front, side and rear views, respectively, of an exemplary peak spray density pattern achieved by the embodiment of a fluid nozzle shown in FIGS. 41-47, according to the present invention.
Figure 48B:
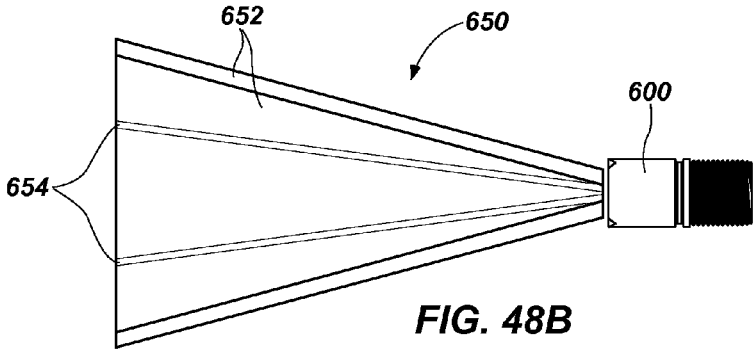
Figure 48C:
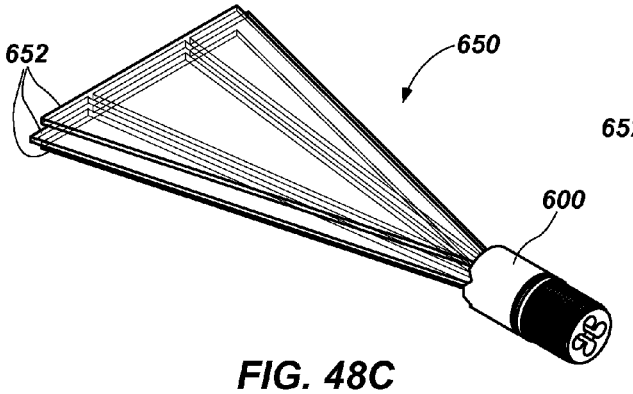
Figure 48D:
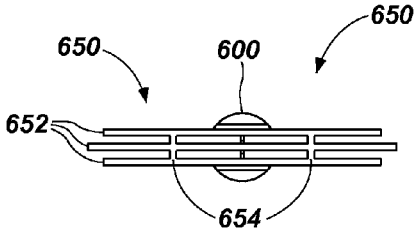
Figure 48F:
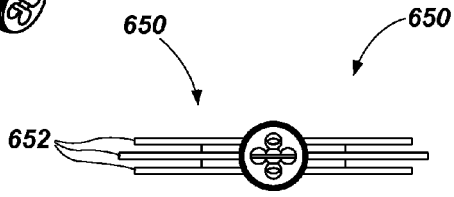
Figure 48E:
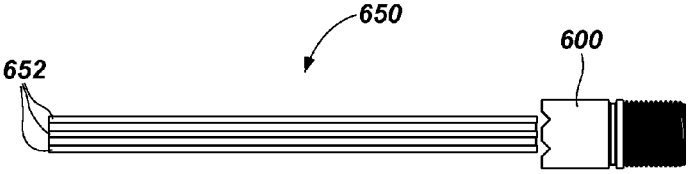

FIG. 47 is a rear perspective view of the embodiment shown in FIGS. 41-46, according to the present invention. More particularly, FIG. 47 illustrates cloverleaf cross-sectioned intake port 612 and fluid chamber 614 disposed in the intake port end 610 of nozzle embodiment 600. FIG. 47 further illustrates chamfers 626 in face 602 along with circular sealing (O-ring) groove 608 of nozzle embodiment 600.

FIGS. 48A-48F are front perspective, top, rear perspective, front, side and rear views, respectively, of an exemplary composite peak spray density pattern 650 achieved by the embodiment of a fluid nozzle 600 shown in FIGS. 41-47, according to the present invention. The composite spray peak density spray pattern 650 generated by nozzle embodiment 600 is characterized by three horizontal peak spray patterns 652 with two vertical peak spray patterns 654 perpendicularly transecting the horizontal patterns 652. Accordingly, and as shown in FIGS. 48A-48F, the composite peak spray density spray pattern 650 is largely horizontal with three planes of flat jets originating from the orifices 604A and 604B.

Yet another embodiment of a nozzle 700 may be achieved by taking the basic structure of nozzle 200 and instead of forming a slotted orifice 204, forming a chamfer 726 in face 702 that cuts into hemispherical impingement surfaces 718 thereby forming three flattened oval cross-sectioned orifices 704. Such an embodiment of a nozzle 700, as shown in FIGS. 49-55 may or may not include pin spanner holes 224 (FIGS. 9, 12 and 14) according to two embodiments of the present invention. However, the embodiment of nozzle 700 described below and shown in FIGS. 49-55 does not include such pin spanner holes 224 (FIGS. 9, 12 and 14) for simplicity of illustration.

Figure 49:
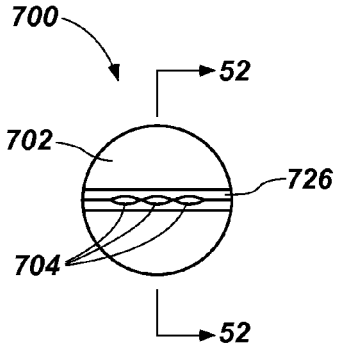
FIG. 49 is a front view of single-slotted, quintuple sub-chambered, dual flat jet embodiment of a fluid nozzle, according to the present invention.

More particularly FIG. 49 is a front view of triple sub-chambered, triple flat jet embodiment of fluid nozzle 700, according to the present invention. FIG. 49 illustrates chamfer 726 disposed in face 702 that cuts into hemispherical impingement surfaces 718 (see FIGS. 52-53) thereby forming three flattened oval cross-sectioned orifices 704.

Figure 50:
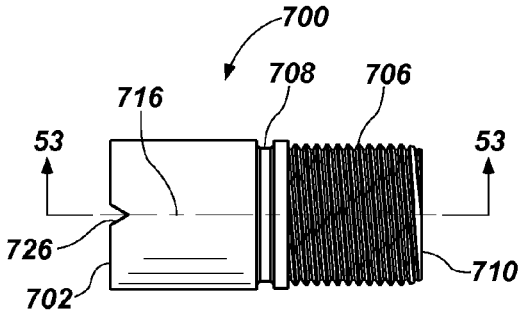
FIG. 50 is a right-side view of the embodiment shown in FIG. 49, according to the present invention.

FIG. 50 is a right-side view of the embodiment of the fluid nozzle 700 shown in FIG. 49, according to the present invention. FIG. 50 illustrates chamfer 726 in face 702 of nozzle embodiment 700. FIG. 50 further illustrates a longitudinal axis 716 (dashed line which also represents section line in FIG. 53), threading 706 located between circular sealing (O-ring) groove 708 and intake port end 710 of nozzle embodiment 700.

Figure 51:
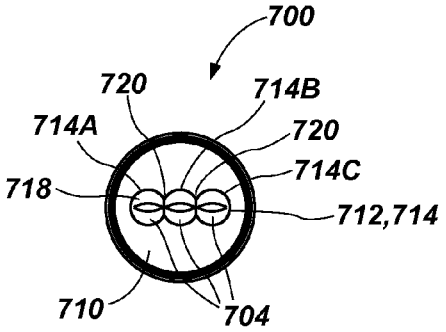
FIG. 51 is a rear view of the embodiment shown in FIGS. 49-50, according to the present invention.

FIG. 51 is a rear view of the embodiment of the fluid nozzle 700 shown in FIGS. 49-50, according to the present invention. FIG. 51 illustrates intake port 712 of fluid chamber 714 as viewed from intake port end 710. Fluid chamber 714 is comprised of three sub-chambers 714A-C separated by ridges 720 that lead to hemispherical impingement surfaces 718 adjacent to the three flattened oval cross-sectioned orifices 704 of nozzle embodiment 700.

Figure 52:
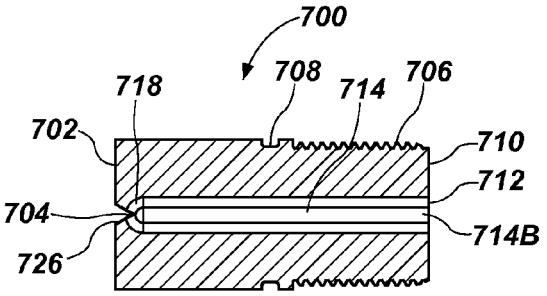
FIG. 52 is vertical section view of the embodiment shown in FIGS. 49-51 as indicated in FIG. 49, according to the present invention.

FIG. 52 is vertical section view as indicated in FIG. 49 of the embodiment of the fluid nozzle 700 shown in FIGS. 49-51, according to the present invention. More particularly, FIG. 52 illustrates a cross-section of intake port 712 at intake port end 710, leading to sub-chamber 714B of fluid chamber 714, which in turn leads to hemispherical impingement surfaces 718 adjacent to a flattened oval cross-sectioned orifice 704 at chamfer 726 of nozzle embodiment 700. Cross-sections of threading 706 and circular sealing (O-ring) groove 708 are also illustrated in FIG. 52.

Figure 53:
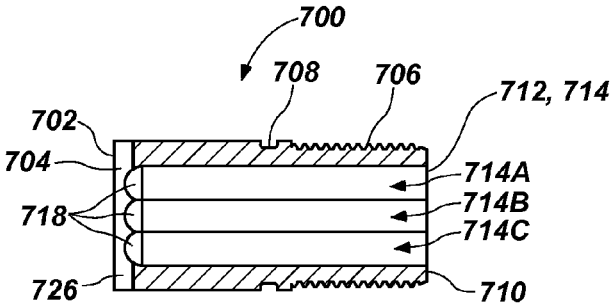
FIG. 53 is horizontal section view of the embodiment shown in FIGS. 49-52 as indicated in FIG. 50, according to the present invention.

FIG. 53 is horizontal section view as indicated in FIG. 50 of the embodiment of the fluid nozzle 700 shown in FIGS. 49-52, according to the present invention. More particularly, FIG. 53 illustrates cross-section of intake port 712 at intake port end 710, leading to all three sub-chambers 714A-C of fluid chamber 714, which in turn leads to hemispherical impingement surfaces 718 adjacent to chamfer 726 of nozzle embodiment 700. Cross-sections of threading 706 and circular sealing (O-ring) groove 708 are also illustrated in FIG. 53.

Figure 54:
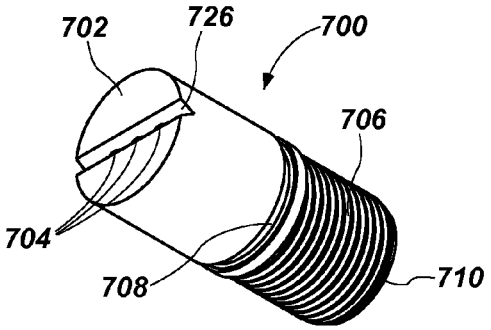
FIG. 54 is a front perspective view of the embodiment shown in FIGS. 49-53, according to the present invention.

FIG. 54 is a front perspective view of the embodiment of the fluid nozzle 700 shown in FIGS. 49-53, according to the present invention. More particularly, FIG. 54 illustrates three flattened oval cross-sectioned orifices 704 at bottom of chamfer 726 disposed in the face 702 of nozzle embodiment 700. FIG. 54 further illustrates threading 706 located between circular sealing (O-ring) groove 708 and intake port end 710 of nozzle embodiment 700.

Figure 55:
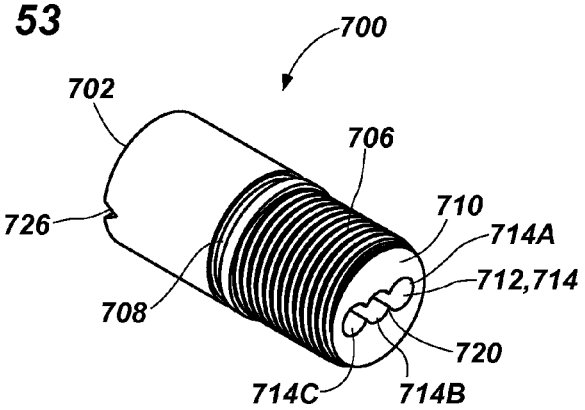
FIG. 55 is a rear perspective view of the embodiment shown in FIGS. 49-54, according to the present invention.
Figure 56A:
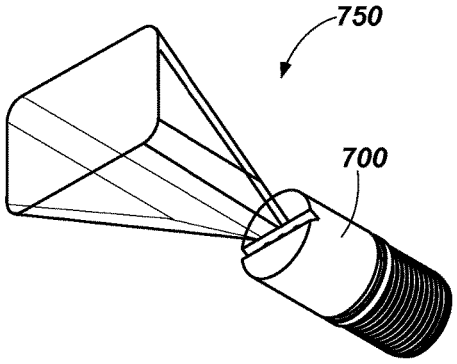
FIGS. 56A-56F are front perspective, top, rear perspective, front, side and rear views, respectively, of an exemplary peak spray density pattern achieved by the embodiment of a fluid nozzle shown in FIGS. 49-55, according to the present invention.
Figure 56B:
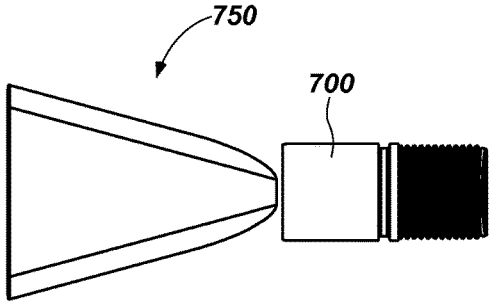
Figure 56C:
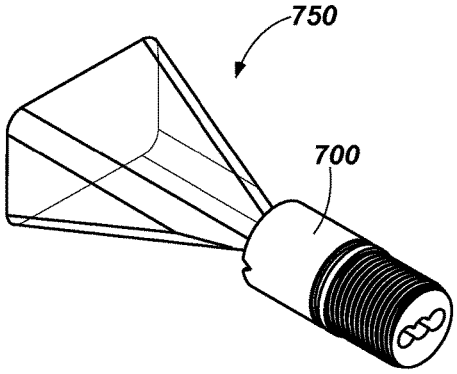
Figure 56D:
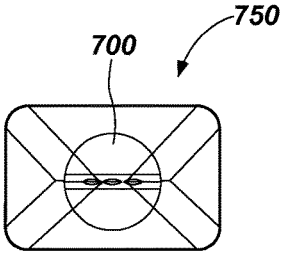
Figure 56E:
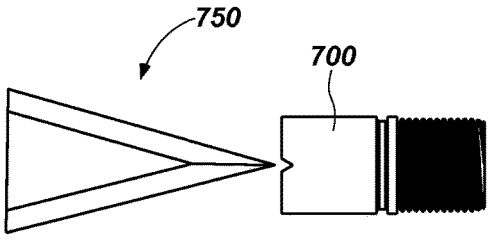
Figure 56F:
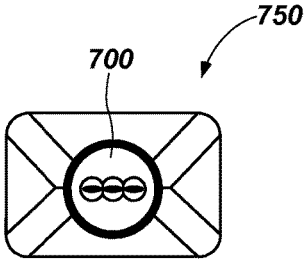
Figure 57A:
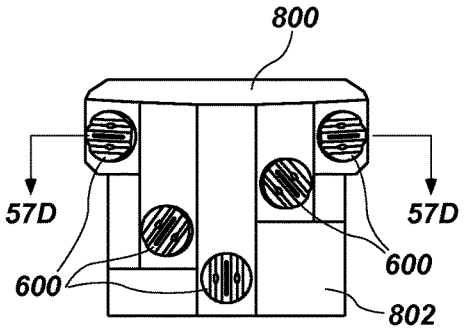
FIGS. 57A-57E are front, bottom, left, cross-section and perspective views of a modular nozzle head, according to the present invention.
Figure 57B:
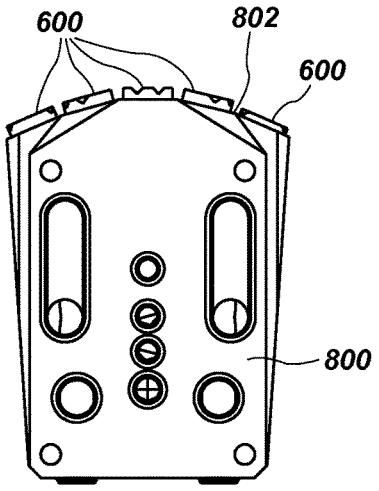
Figure 57C:
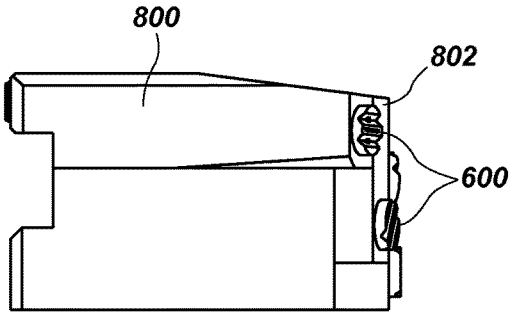
Figure 57D:
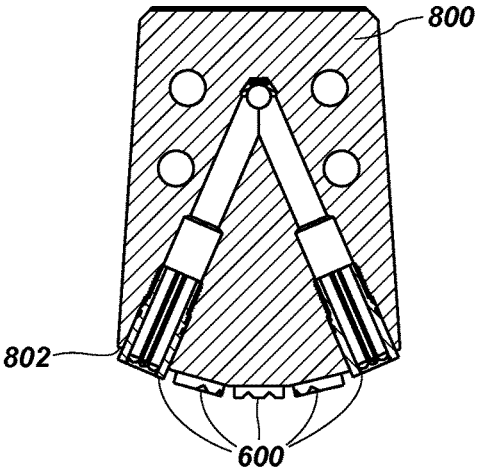
Figure 57E:
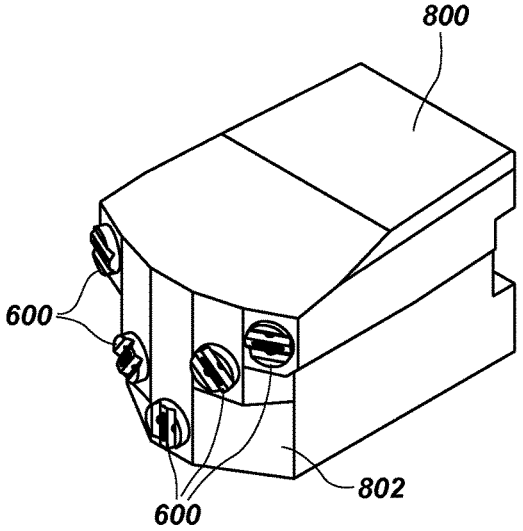

FIG. 55 is a rear perspective view of the embodiment of the fluid nozzle 700 shown in FIGS. 49-54, according to the present invention. More particularly, FIG. 55 illustrates intake port 712 of fluid chamber 714, comprised of all three sub-chambers 714A-C, formed in intake port end 710 of nozzle embodiment 700. FIG. 55 further illustrates chamfer 726 located in face 702 as well as threading 706 located between circular sealing (O-ring) groove 708 and intake port end 710 of nozzle embodiment 700.

FIGS. 56A-56F are front perspective, top, rear perspective, front, side and rear views, respectively, of an exemplary composite peak spray density pattern 750 achieved by the embodiment of a fluid nozzle 700 shown in FIGS. 49-55, according to the present invention. Composite pattern 750 is dual vectored, but without clearly discernible horizontal and vertical peak densities.

FIGS. 57A-57E are front, bottom, left, cross-section and perspective views of a modular nozzle head 800, according to the present invention. Embodiments of the modular nozzle head 800 may be configured to receive any number of the modular dual vector fluid nozzles 100, 200, 300, 400, 500, 600 and 700 disclosed herein. In the particular embodiment illustrated in FIGS. 57A-57E, five of the nozzle embodiment 600 are shown installed in the face 802 of head 800. Note that the rotational orientation of the nozzles 600 may be in any suitable orientation. Note further that the face 802 may be, linear, arcuate, curved, or piecewise curvilinear in cross-section, see FIG. 57D.

It will be understood that each longitudinal axis 116, 216, 316, 416, 516, 616 and 716 described herein may also be fluid channel axis or a sub-channel axis as well as an axis of a cylindrical housing from which the particular nozzle is formed. Though the term longitudinal axis has been used extensively herein, it will be understood that each of the sub-channels described herein may have its own sub-channel axis as the sub-channels are generally cylindrical openings. It will be further understood that the term "intake port end" may be synonymous with the term proximate end. Similarly, the term "face" may be synonymous with the term "distal end". It will be further understood that each of the nozzles 100, 200, 300, 400, 500, 600 and 700 shown in the drawings herein is comprised of a cylindrical housing about which the novel and nonobvious features are formed on or within, other suitable housing shapes could be used consistent with the teachings of this disclosure.

Having described the embodiments of nozzles shown in the drawings and their particular structural features, variations and resulting spray patterns using particular terminology, additional embodiments of dual vector fluid spray nozzles will now be disclosed. The following embodiments may or may not correspond precisely to the illustrated embodiments, but will have structure and features that are readily apparent based on the description of the drawings as provided herein.

An embodiment of a fluid nozzle is disclosed. The fluid nozzle may include an integral cylindrical housing further including a fluid channel having a fluid channel axis, or longitudinal axis, disposed coaxially through the cylindrical housing from a fluid intake port on a proximate end to an orifice at a distal end. According to one embodiment of a fluid nozzle, the orifice may be a slotted orifice. According to an embodiment of the fluid nozzle, the fluid channel may further include a plurality of cylindrical sub-channels, each of the plurality of sub-channels having a sub-channel axis parallel to the fluid channel axis beginning from the intake port and passing through the slotted orifice. According to another embodiment of the fluid nozzle, each of the cylindrical sub-channels may be formed by a bore hole beginning from the proximate or intake port end of the cylindrical housing and ending in opposed hemispherical impingement surfaces at the slotted orifice.

According to another fluid nozzle embodiment, the integral cylindrical housing may further include external threading along an outer surface adjacent to the proximate end, the threading configured for mounting the fluid nozzle to a fluid spray system, fixture, or nozzle head (see, e.g., 800, FIGS. 57A-57E). The threading may be configured to mate with threading in a fluid spray system or fixture head, thus allowing the nozzles to be removable for servicing and replacement. One particularly useful feature of the fluid nozzles disclosed herein is that they are modular and can be replaced with identical or various configurations of nozzles 100, 200, 300, 400, 500, 600 and 700, for example.

According to still another fluid nozzle embodiment, the integral cylindrical housing may further comprises a circumferential, or circular sealing, groove formed within the cylindrical housing at a location between the proximate end and the distal end, or face, the groove adapted to receive an O-ring for sealing the threading.

According to yet another fluid nozzle embodiment, the integral cylindrical housing may further include means for applying rotational torque to the fluid nozzle to install or remove the fluid nozzle from a fluid spray system head. According to one such means embodiment, pin spanner holes (224, FIGS. 9, 12 and 14) may be formed in the face or distal end of the nozzle housing for mating with a pin spanner wrench. Thus, according to this particular means for applying rotational torque, two holes may be formed in the distal end of the cylindrical housing, the pin holes configured for receiving pins from a spanner wrench. According to other means embodiments, the distal end or body of cylindrical housing may be shaped to receive a square socket, hexagonal socket, octagonal socket or spanner wrench.

According to one fluid nozzle embodiment, the plurality of sub-channels may be two sub-channels. According to another fluid nozzle embodiment, the plurality of sub-channels comprises three sub-channels. According to still another fluid nozzle embodiment, the sub-channel axes of the three sub-channels may all fall in a single plane.

According to yet another fluid nozzle embodiment, a cross-section of the intake port at the proximate end may comprise a plurality of circular openings, each of the plurality of circular openings touching an adjacent circular opening and each circular opening surrounding a portion of a volume formed by sweeping the slotted orifice along the fluid channel axis from the distal end to the proximate end. Stated another way, this embodiment implies that the cross-section of the intake port is the same as the cross-section of the fluid channel. According to one fluid nozzle embodiment, each of the plurality of circular openings formed in the proximate, or intake port end, corresponds to one of the plurality of sub-channels of the nozzle fluid chamber.

According to one fluid nozzle embodiment, a spray pattern generated by pressurized fluid entering the intake port and exiting the orifice of the fluid nozzle forms a plume of fluid vapor having a horizontally oriented main plume exiting radially along a plane formed by the slotted orifice and the fluid channel axis, and having a plurality of vertically oriented plumes exiting the slotted orifice in planes oriented perpendicularly relative to the main plume. According to a particular fluid nozzle embodiment, each of the plurality of vertically oriented plumes is formed by the intersection of adjacent sub-channels. According to still another fluid nozzle embodiment, each of the plumes, vertical or horizontal, is a peak fluid vapor density along an exit trajectory plane.

According to yet another embodiment, the fluid nozzle may further include at least one secondary fluid channel may be formed in the cylindrical housing and spaced apart from, and parallel to, the fluid channel.

According to one embodiment of a fluid nozzle, the secondary fluid channel further include a plurality of secondary cylindrical sub-channels, each of the plurality of secondary cylindrical sub-channels having a secondary sub-channel axis disposed parallel to the fluid channel axis beginning from a secondary intake port formed at the proximate end and passing through a secondary slotted orifice formed in the distal end.

According to another embodiment of a fluid nozzle, each of the secondary cylindrical sub-channels may be formed by a secondary bore hole beginning from the proximate end of the cylindrical housing and ending in opposed hemispherical impingement surfaces at the second slotted orifice.

According to another embodiment of a fluid nozzle, the secondary bore hole diameters are less than the bore hole diameters of the cylindrical sub-channels forming the fluid channel. It will be understood that the scale of the fluid channels may be changed according to various embodiments of the nozzles disclosed herein.

According to one embodiment of a fluid nozzle, the at least one secondary fluid channel may include two secondary fluid channels, each secondary fluid channel may be disposed parallel to the fluid channel, but on opposed sides of the fluid channel. For example and not by way of limitation, see nozzle 300 in FIGS. 17-23.

According to another embodiment of a fluid nozzle, a composite fluid spray pattern generated by pressurized fluid entering the intake port and exiting the orifice of the fluid nozzle forms a plume of fluid vapor having a horizontally oriented main plume exiting radially along a plane formed by the slotted orifice and the fluid channel axis, two horizontally oriented secondary plumes, each exiting radially along planes formed by respective secondary slotted orifices and the associated secondary fluid sub-channel channel axes and having a plurality of vertically oriented plumes exiting the slotted orifice and the secondary slotted orifices, each vertically oriented plume lying in a plane oriented perpendicular relative to the main plume.

Another embodiment of a fluid nozzle is disclosed. This embodiment of a fluid nozzle may include an integral cylindrical housing including a fluid channel disposed therein having a fluid channel axis disposed coaxially through the cylindrical housing from a fluid intake port on a proximate end to a cross-slotted orifice at a distal end. According to still another embodiment of a fluid nozzle, the fluid channel may further include a plurality of cylindrical sub-channels, each of the plurality of sub-channels having a sub-channel axis parallel to the fluid channel axis beginning from the intake port and passing through the cross-slotted orifice. According to still another embodiment of a fluid nozzle, each of the cylindrical sub-channels may be formed by a bore hole beginning from the proximate end of the cylindrical housing and ending in opposed semi-spherical impingement surfaces at the cross-slotted orifice.

According to one embodiment of a fluid nozzle, the plurality of cylindrical sub-channels may include a central cylindrical sub-channel and four quadrature sub-channels, the central cylindrical sub-channel sharing the fluid channel axis centered on the cross-slotted orifice, each of the four quadrature sub-channels having an axis falling on an arm of the cross-slotted orifice. One such embodiment is nozzle 400 shown in FIGS. 25-31.

According to another embodiment of a fluid nozzle, the integral cylindrical housing may further include external threading along an outer surface adjacent the proximate end, the threading configured for mounting the fluid nozzle to a fluid spray system head or fixture. According to still another embodiment of a fluid nozzle, the integral cylindrical housing further comprises a circumferential groove formed within the housing, the groove adapted to receive an O-ring for sealing the threading.

According to yet another embodiment of a fluid nozzle, a cross-section of the intake port at the proximate end comprises a central circular opening and four quadrature circular openings, each quadrature circular opening surrounding the central circular opening at 90° intervals, each of the quadrature circular openings touching the central circular opening.

According to one embodiment of a fluid nozzle, a plume of fluid vapor generated by pressurized fluid entering the intake port and exiting the cross-slotted orifice of the fluid nozzle forms a composite spray pattern. According to one embodiment, the composite spray pattern may include intersecting horizontally and vertically oriented main plumes exiting radially along a planes formed by the cross-slotted orifice and the fluid channel axis. The composite spray pattern may further include two laterally oriented secondary plumes, each exiting radially along planar trajectories not intersecting, on opposite sides of, and at an acute angle relative to, the horizontal main plume, each horizontally oriented secondary plume lying in a respective plane oriented perpendicular relative to the vertically oriented main plume. The composite spray pattern may further include two vertically oriented secondary plumes, each exiting radially along other planar trajectories not intersecting, on opposite sides of, and at an acute angle relative to, the vertical main plume, each vertically oriented secondary plume lying in a respective plane oriented perpendicular relative to the horizontal main plume.

Still another embodiment of a fluid nozzle is disclosed. The embodiment of a fluid nozzle may include an integral cylindrical housing including a fluid channel having a fluid channel axis disposed coaxially through the cylindrical housing from a fluid intake port on a proximate end to a main slotted orifice at a distal end. According to one embodiment the fluid channel may further include a plurality of cylindrical sub-channels, each of the plurality of sub-channels having a sub-channel axis parallel to the fluid channel axis beginning from the intake port and passing through the main slotted orifice or one of two secondary slotted orifices, the two secondary slotted orifices formed in the distal end of the housing and disposed parallel to, and on opposite sides of, the main slotted orifice. The embodiment of a fluid nozzle may further include each of the cylindrical sub-channels formed by boring a hole beginning from the proximate end of the cylindrical housing and ending in opposed hemispherical impingement surfaces at one of the main or secondary slotted orifices.

According to another embodiment of a fluid nozzle, the plurality of cylindrical sub-channels may include a central cylindrical sub-channel, two horizontal sub-channels and two vertical sub-channels, the central cylindrical sub-channel sharing the fluid channel axis centered on the main slotted orifice, each of the two horizontal sub-channels having an axis passing through the main slotted orifice and each of the two vertical sub-channels having an axis passing through one of the secondary slotted orifices.

According to another embodiment of a fluid nozzle, the integral cylindrical housing may further include external threading along an outer surface adjacent the proximate end, the threading configured for mounting the fluid nozzle to a fluid spray system head or fixture. According to still another embodiment of a fluid nozzle, the integral cylindrical housing may further include a circumferential groove formed within the housing, the groove adapted to receive an O-ring for sealing the threading.

According to yet another embodiment of a fluid nozzle, a cross-section of the intake port at the proximate end may include a central circular opening and two horizontally oriented circular openings and two vertically oriented circular openings, each of the horizontal and vertical circular openings surrounding the central circular opening at 90° intervals, each of the circular openings touching the central circular opening.

According to a particular embodiment of a fluid nozzle, a plume of fluid vapor generated by pressurized fluid entering the intake port and exiting the main slotted orifice and secondary slotted orifices of the fluid nozzle forms a composite spray pattern. The composite spray pattern of this embodiment may include a horizontally oriented main plume exiting radially along a plane formed by the main slotted orifice and the fluid channel axis. The composite spray pattern of this embodiment may further include two horizontally oriented secondary plumes, each exiting radially along planar trajectories not intersecting, on opposite sides of, and at parallel relative to, the horizontal main plume. The composite spray pattern of this embodiment may further include two vertically oriented secondary plumes, each exiting radially along other planar trajectories not intersecting and at an acute angle relative to one another, each vertically oriented secondary plume lying in a respective plane oriented perpendicular relative to the horizontal main plume.

The embodiments of dual vector fluid nozzles disclosed herein and their components may be formed of any suitable materials, such as aluminum, copper, stainless steel, titanium, carbon fiber composite materials and the like. The component parts may be manufactured according to methods known to those of ordinary skill in the art, including by way of example only, machining and investment casting. Assembly and finishing of nozzles according to the description herein is also within the knowledge of one of ordinary skill in the art and, thus, will not be further elaborated herein.

In understanding the scope of the present invention, the term "fluid channel" is used to describe a three-dimensional space disposed within a cylindrical housing that begins at a fluid intake port and ends at an orifice. In understanding the scope of the present invention, the term "fluid chamber" is used herein synonymously with the term "fluid channel". In understanding the scope of the present invention, the term "configured" as used herein to describe a component, section or part of a device may include any suitable mechanical hardware that is constructed or enabled to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part", "section", "portion", "member", or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions relative to the front of an embodiment of a nozzle that has an orifice as described herein. Finally, terms of degree such as "substantially", "about" and "approximately" as used herein mean a reasonable amount of deviation of the modified term such that the end result is not significantly changed.

While the foregoing features of the present invention are manifested in the detailed description and illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. A fluid nozzle, comprising:

an integral cylindrical housing including a fluid channel having a fluid channel axis disposed coaxially through the cylindrical housing from a fluid intake port on a proximate end to a slotted orifice at a distal end, the slotted orifice having parallel opposed edges at the distal end, an exit plane passing between, and parallel to, the parallel opposed edges;

the fluid channel further comprising a plurality of cylindrical sub-channels, each of the plurality of sub-channels having a sub-channel axis parallel to the fluid channel axis, each sub-channel axis beginning from the intake port and passing through the slotted orifice along the exit plane;

each of the cylindrical sub-channels formed by a bore hole beginning from the proximate end of the cylindrical housing and ending in opposed hemispherical impingement surfaces at the slotted orifice; and wherein a cross-section of the intake port at the proximate end comprises a plurality of circular openings, each of the circular openings intersecting an adjacent circular opening and each of the plurality of circular openings corresponds to one of the plurality of channels.

2. The fluid nozzle according to claim 1, wherein the integral cylindrical housing further comprises external threading along an outer surface adjacent the proximate end, the threading configured for mounting the fluid nozzle to a fluid spray system head.

3. The fluid nozzle according to claim 2, wherein the integral cylindrical housing further comprises a circumferential groove formed within the housing at a location between the proximate end and the distal end, the groove adapted to receive an O-ring for sealing the threading.

4. The fluid nozzle according to claim 1, wherein the plurality of sub-channels comprises two sub-channels.

5. The fluid nozzle according to claim 1, wherein each of the plurality of circular openings surrounding a portion of a volume formed by sweeping the slotted orifice along the fluid channel axis from the distal end to the proximate end.

6. The fluid nozzle according to claim 5, wherein a composite spray pattern generated by pressurized fluid entering the intake port and exiting the orifice of the fluid nozzle forms a plume of fluid vapor having a horizontally oriented main plume exiting radially along a plane formed by the slotted orifice and the fluid channel axis, and having a vertically oriented plume exiting the slotted orifice in a plane oriented perpendicularly relative to the main plume.

7. The fluid nozzle according to claim 6, wherein the vertically oriented plume is formed by the intersection of adjacent sub-channels.

8. The fluid nozzle according to claim 6, wherein each of the plumes, vertical or horizontal, comprises a peak fluid vapor density along an exit trajectory plane.

* * * * *